US007341042B1

(12) United States Patent
Chung et al.

(10) Patent No.: US 7,341,042 B1
(45) Date of Patent: Mar. 11, 2008

(54) ROTARY POSITIVE DISPLACEMENT CONTROL SYSTEM AND APPARATUS

(75) Inventors: Tien-tung Chung, Taipei Hsien (TW); Heng-i Lin, Taipei Hsien (TW); Tsang-lin Hsu, Taipei Hsien (TW); Chin-te Lin, Taipei Hsien (TW)

(73) Assignee: Liung Feng Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/585,942

(22) Filed: Oct. 25, 2006

(30) Foreign Application Priority Data

Jul. 21, 2006 (TW) ..... 95126611 A

(51) Int. Cl.
*F02B 53/00* (2006.01)
*F02B 53/08* (2006.01)

(52) U.S. Cl. ..... 123/232; 123/238; 123/248

(58) Field of Classification Search ..... 123/232, 123/238, 248, 249, 233, 234, 235, 236, 237, 123/204
See application file for complete search history.

(56) References Cited

U.S. PATENT DOCUMENTS 2,058,817 A * 10/1936 Northey ..... 123/202
3,699,930 A * 10/1972 Bunce ..... 123/235
3,782,340 A * 1/1974 Nam ..... 123/204
4,012,903 A * 3/1977 Riedl ..... 60/39.45
4,512,302 A * 4/1985 Bunce ..... 123/238
4,971,002 A * 11/1990 Le ..... 123/238
5,329,900 A * 7/1994 Dye ..... 123/238
6,481,410 B1 * 11/2002 Ogilvie ..... 123/204

* cited by examiner

*Primary Examiner*—Thomas Denion
*Assistant Examiner*—Mary A Davis
(74) *Attorney, Agent, or Firm*—Rosenberg, Klein & Lee

(57) ABSTRACT

A rotary positive displacement control system and apparatus includes a transmission assembly, at least a compression assembly and buffer assembly, and an expansion assembly, the buffer assembly disposed between the compression and expansion assembly. The compression assembly includes multiple compression rotors with lobes intermeshing with each other, and the expansion assembly including expansion rotors with lobes intermeshing with each other. An intake and exhaust port respectively located at the compression assembly and expansion assembly. The buffer assembly has a buffer chamber being able to efficiently lead compressed gases to the expansion assembly; meanwhile, residual gases can be discharged from a first and second exhaust slots both disposed on the expansion assembly. The buffer chamber can adjust air compression ratio during process of compression to completely mix vortexes and fuel generated from a high-pressure air stream; after explosions and expansion, power output is transmitted through transmission shafts directly.

25 Claims, 22 Drawing Sheets

ROTARY POSITIVE DISPLACEMENT CONTROL SYSTEM AND APPARATUS

BACKGROUND OF THE INVENTION

1. Field of the Invention

The present invention relates to a rotary positive displacement control system and apparatus, and particularly to a rotary positive displacement system and apparatus operating by ways of a periodic process of suction, expansion, compression, exhaust, and can be adapted to engines, vacuum pumps, internal combustion machines, compressors and rotary positive displacements.

2. Related Art

Generally, a concept of supercharging is that force air into an intake port of a sealing chamber which is equipped with multiple rotors rotating continuously and meshing with each other, in which air flows through a transmitting chamber and is compressed after rotation of the rotors and turns to be high pressure air, then air is discharged from the exhaust port. Due to such operation cycle, air is of high compression ratio. The character of high compression ratio can be used to apparatuses like engines, vacuum pumps, internal combustion machines and compressors and so on for improving working performance, lowering oil consumption, and reducing air pollution. Related structure of supercharging apparatus has been disclosed in numerous prior arts, such as U.S. Pat. Nos. 4,008,693, 4,321,897, 4,512,302, 4,813,388, 4,825,827, 5,329,900, 6,129,067, 6,481,410.

However, in prior arts there are still some disadvantages to the periodic operation process of suction, expansion, compression and exhaust. Those disadvantages lower the working performance of the apparatuses. That is, in prior arts, during periodic operation process, residual gases remain because of incomplete exhaust, even though the apparatus runs with a rotary positive displacement cannot avoid remaining residual gases. As a result, the apparatus cannot have a well efficiency in providing power and a longer lifespan. Moreover, power output of some apparatuses, such as engines, is transmitted through crankshafts, while the quality of the crankshafts will affect process of operation; if the crankshafts are of poor quality, the accuracy of dynamic balance is no longer accurate, which will cause unstable performance, shorten lifespan, and increase unnecessary power consumption.

SUMMARY OF THE INVENTION

Accordingly, an object of the present invention is to provide a rotary positive displacement control system and apparatus, which can completely discharge residual gases and transmit power without crankshafts, that is, a rotary positive displacement control system and apparatus of the present invention can provide high pressure air during process of compression and can directly transmit combustion expansion power in order to increase operation efficiency and enhance power output.

Another object of the present invention is to provide a rotary positive displacement control system which can be axially or radially extended or can be extended with whole system.

To achieve the above-mentioned objects, a rotary positive displacement control system and apparatus of the present invention includes a transmission assembly, at least a compression assembly, a buffer assembly and an expansion assembly, the buffer assembly disposed between the compression and expansion assembly. The compression assembly includes multiple compression rotors with lobes intermeshing with each other, and the expansion assembly includes expansion rotors with lobes intermeshing with each other. An intake and exhaust ports are respectively located at the compression assembly and expansion assembly. A first and second intake slots are respectively disposed on opposite sides of the compression assembly, wherein the first intake slot is corresponding to an initial seal zone where the compression rotors initially intermesh with each other. The second intake slot is defined within three curves, including: an arc of a base circle of one of the compression rotors (said arc drawn with a minimum radius of the compression rotor), a profile curve of the lobe of the compression rotor being tangent to said arc of the base circle, and a maximum curve of the adjoining compression rotor drawn with a maximum radius thereof and being tangent to said arc of the base circle.

The expansion rotor of the expansion assembly has a concavity corresponding to the first exhaust slot, the concavity being defined by following steps:

as the intermeshing expansion rotors rotate up to a combustion area, designate a point Q at circumference of the base circle of one of the expansion rotors, the point Q corresponding to the combustion area, and draw a line QO by connecting the point Q and a center O of the base circle; then rotate the expansion rotor backwards till a recess of the lobe is against a tip of a lobe of an adjoining expansion rotor where a point S is defined as an intersection of the tip and the recess of the lobe, and a point P is defined as an intersection of a projecting curve of the lobe of the adjoining expansion rotor and the recess of the lobe, and then respectively connect the point S and P to the center O, whereby an angle SOP and angle SOQ are formed and subject to change on rotation of the expansion rotors. Take the angle SOP as two times large as the angle SOQ, then make an angle bisector of the angle SOP intersect the profile of the expansion rotor at a point R to form an angle bisector OR; connect point R and S to form a curve SR; draw an arc about the center O to intersect a line SO and line RO to form an arc C; whereby, the concavity is defined within an area of the curve SR, the arc C, the line SO and line RO.

The buffer assembly has a buffer chamber being able to efficiently lead compressed gases to the expansion assembly; meanwhile, residual gases s can be discharged from a first and second exhaust slots both disposed on the expansion assembly. The buffer chamber can adjust air compression ratio during process of compression.

DESCRIPTION OF THE PREFERRED EMBODIMENTS

Figure 1:
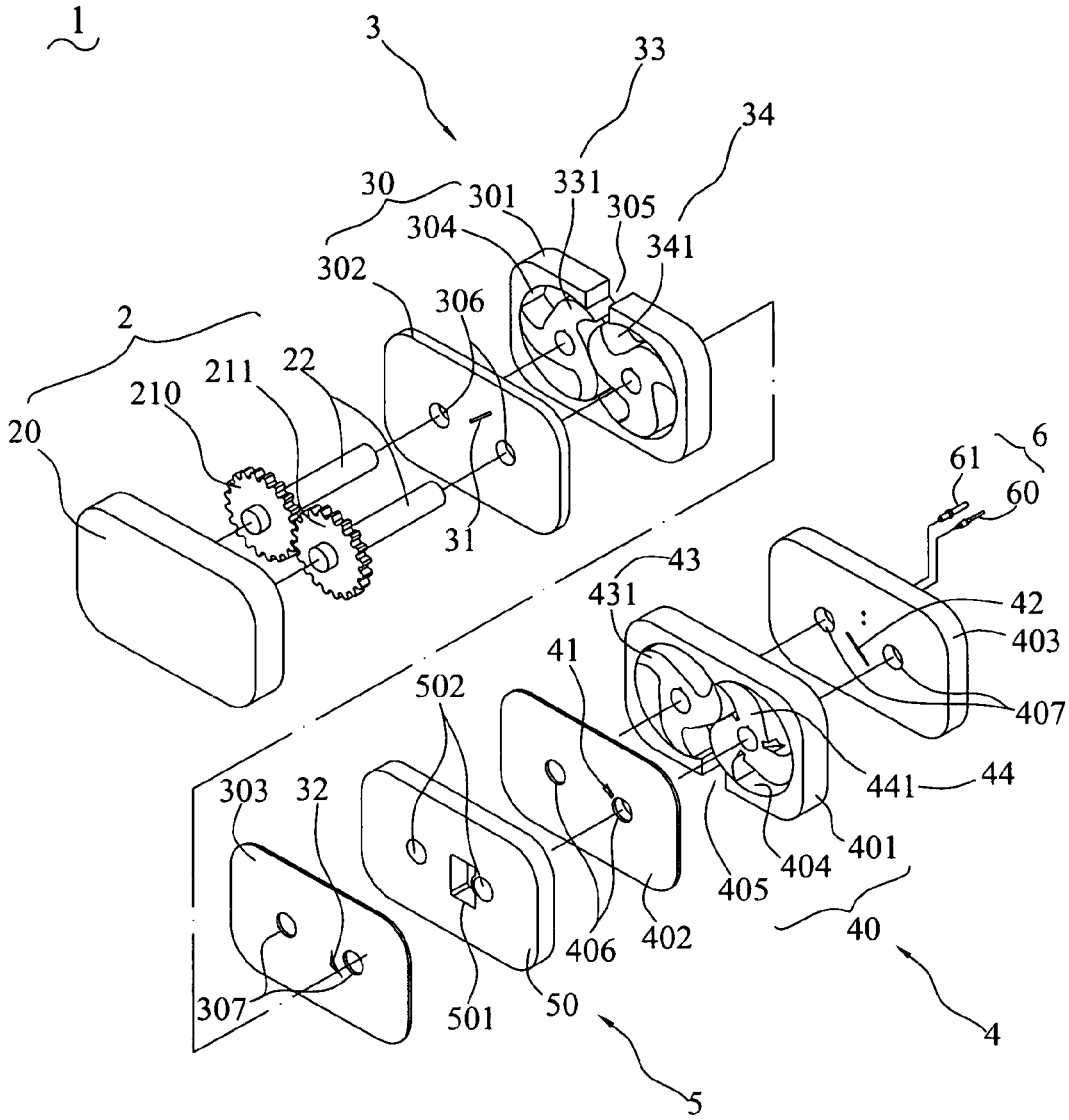
FIGS. 1 and 2 are respectively a perspective exploded view and perspective assembled view of the first embodiment of the present invention.
Figure 2:
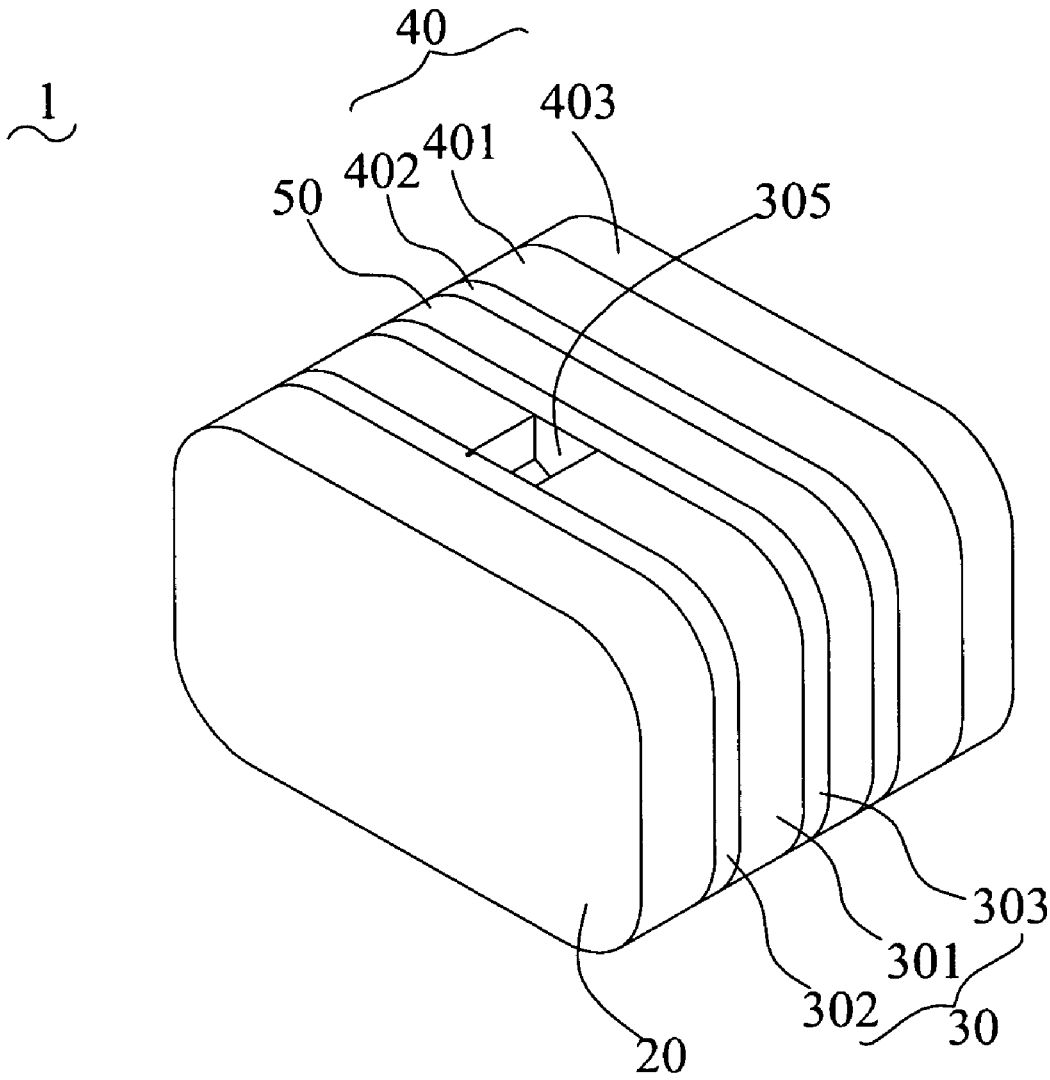

With respect to FIG. 1, the first embodiment of the present invention applied to an engine 1, the engine 1 includes a transmission assembly 2, a compression assembly 3, an expansion assembly 4, a buffer assembly 5, and a supply assembly 6, wherein the transmission assembly 2 includes a axial base 20, a plurality of transmission members pivotally mounted on the axial base 20; in the first embodiment the transmission members are a first gear 210, a second gear 211 being engaged with each other, and a plurality of transmission shafts 22 being parallel to each other for carrying the first and second gears 210, 211.

The compression assembly 3 includes a sealing first chamber 30, a first intake slot 31 and a second intake slot 32, wherein the sealing first chamber 30 includes a first housing 301 sealed by a first casing 302 and a second casing 303, the first housing 301 having a compression chamber 304 which accommodates a plurality of compression rotors 33, 34 intermeshing with each other and respectively pivotally mounted to the transmission shafts 22. Each compression rotor 33, 34 has three identical projecting lobes being evenly spaced around the compression rotor 33, 34. An intake port 305 is defined on the first housing 301 and communicates with the compression chamber 304 for taking air in. The first and second casings 302, 303 respectively have a plurality of coupling holes 306, 307 corresponding to the transmission shafts 22 carrying the first and second gears 210, 211 thereon.

Figure 3A:
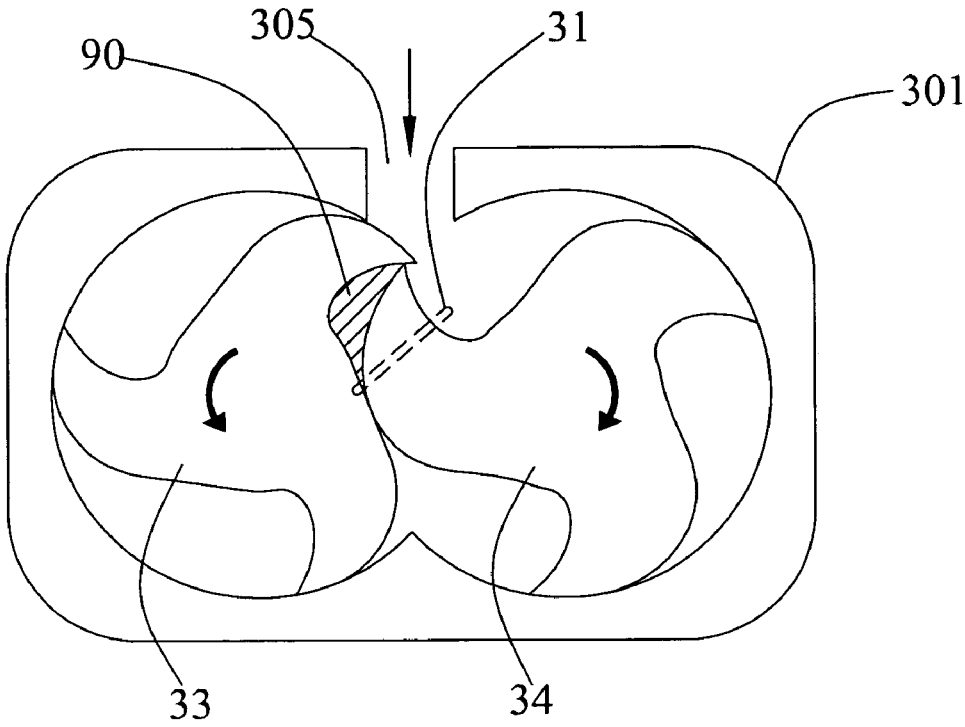
FIGS. 3A to 3H are schematic views showing a process of operation of a compression assembly of the first embodiment.

Referring to FIG. 3A, the first intake slot 31 is corresponding to an initial seal zone 90 where the compression rotors 33, 34 initially intermesh with each other.

Figure 3B:
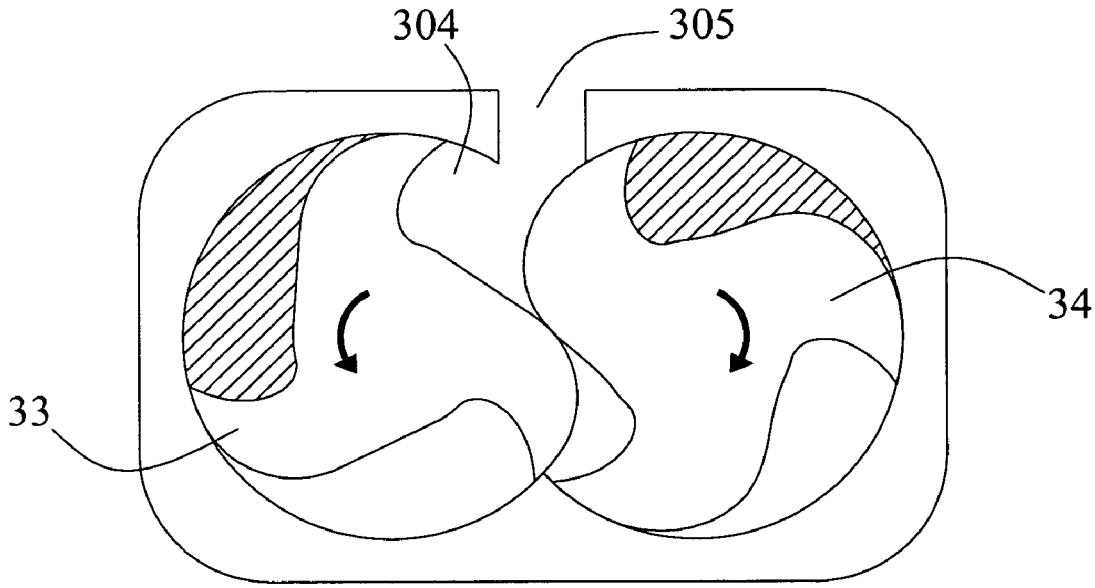
Figure 3C:
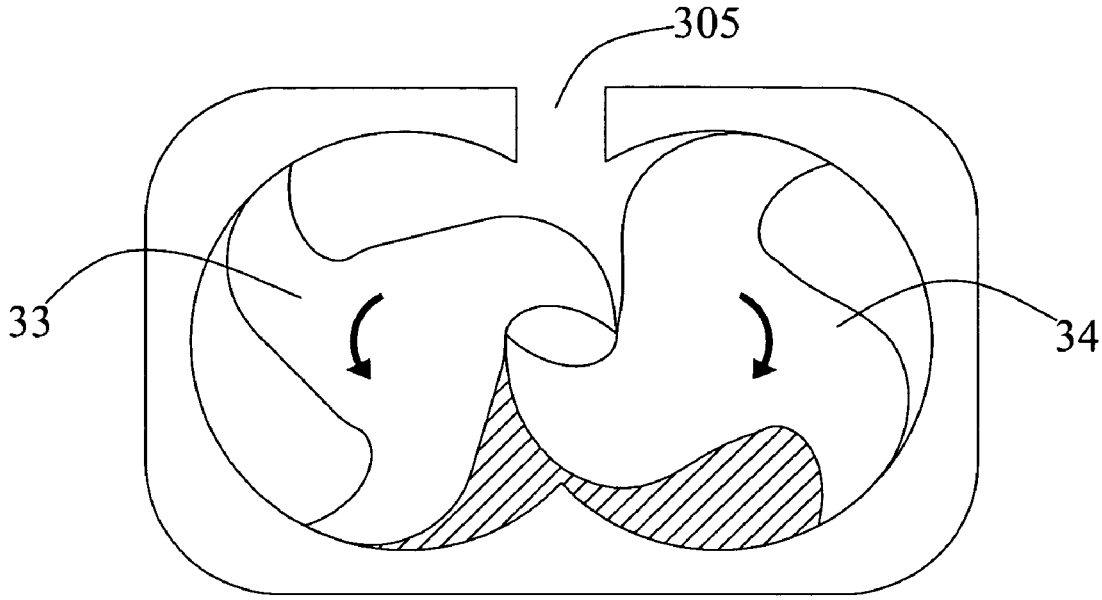
Figure 3D:
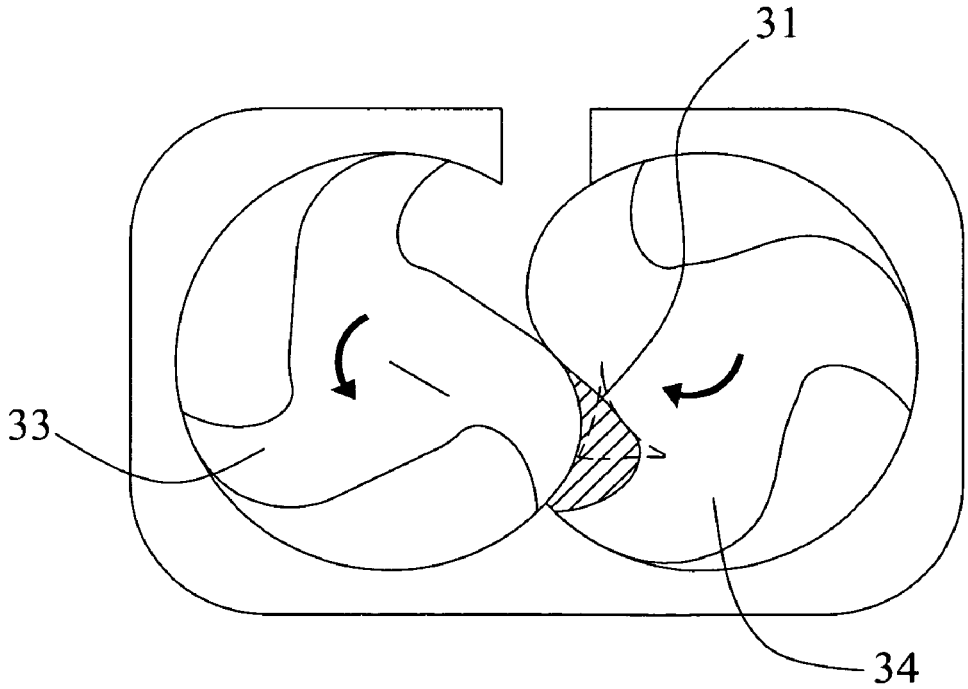
Figure 3E:
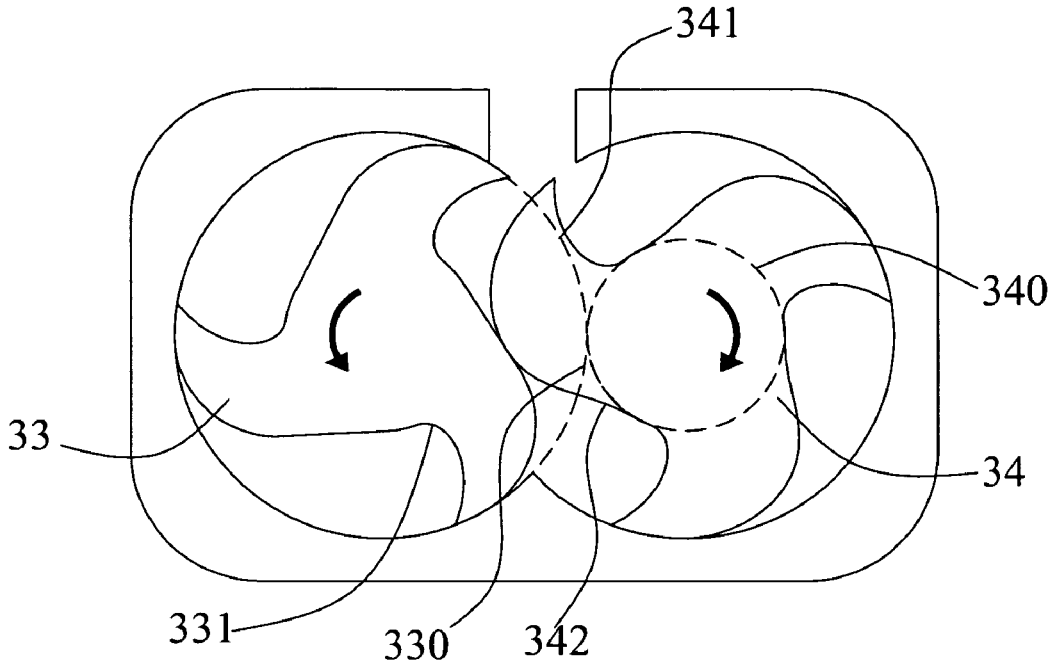
Figure 3F:
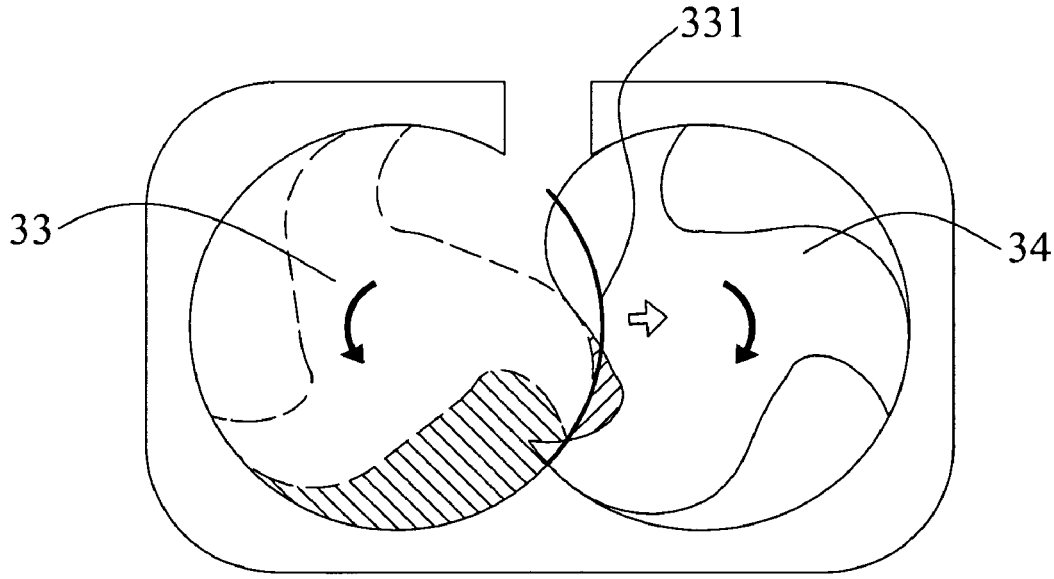
Figure 3G:
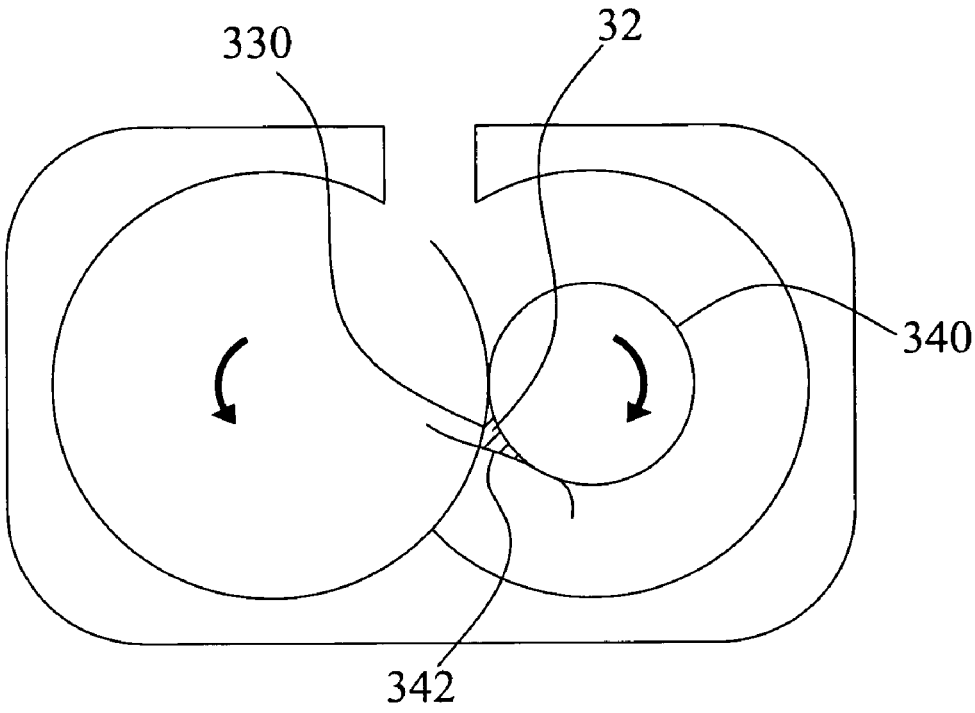

Referring to FIGS. 3E to 3G, a profile of the second intake slot 32 is defined within three curves, comprising: an arc of a base circle 340 of one of the compression rotors 34 (said arc 340 drawn with a minimum radius of the compression rotor 34), a profile curve 342 of the lobe 341 of the compression rotor 34 being tangent to said arc of the base circle 340, and a maximum curve 330 of the adjoining compression rotor 33 drawn with a maximum radius thereof and being tangent to said arc of the base circle 340.

Referring back to FIG. 1, the expansion assembly 4 includes a sealing second chamber 40, a first exhaust slot 41 and a second exhaust slot 42, wherein the sealing second chamber 40 includes a second housing 401 sealed by a third casing 402 and a fourth casing 403, the second housing 401 having a expansion chamber 404 which accommodates a plurality of expansion rotors 43, 44 intermeshing with each other and respectively pivotally mounted to the transmission shafts 22, each expansion rotor 43, 44 has three identical projecting lobes 431, 441 being evenly spaced around the expansion rotor 43, 44, the lobes 431, 441 projecting in counter direction to the lobes 331, 341 of the compression rotors 33, 34. A rotating direction of the compression rotors 33, 34 and expansion rotors 43, 44 are the same, of which a rotating ratio is 1:1. An exhaust port 405 is disposed on the second housing 401 and communicates with the expansion chamber 404 for discharging air. The third and fourth casings 402, 403 respectively have a plurality of coupling holes 406, 407 corresponding to the transmission shafts 22 carrying the first and second gears 210, 211 thereon.

Figure 4A:
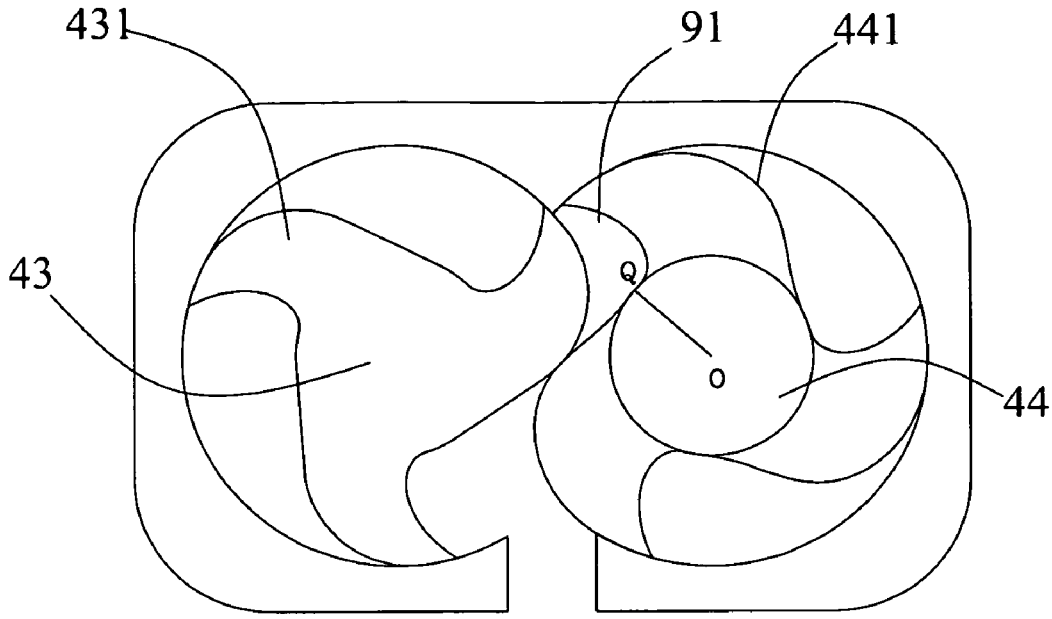
FIGS. 4A to 4F are schematic views showing a process of operation of a buffer assembly of the first embodiment.
Figure 4B:
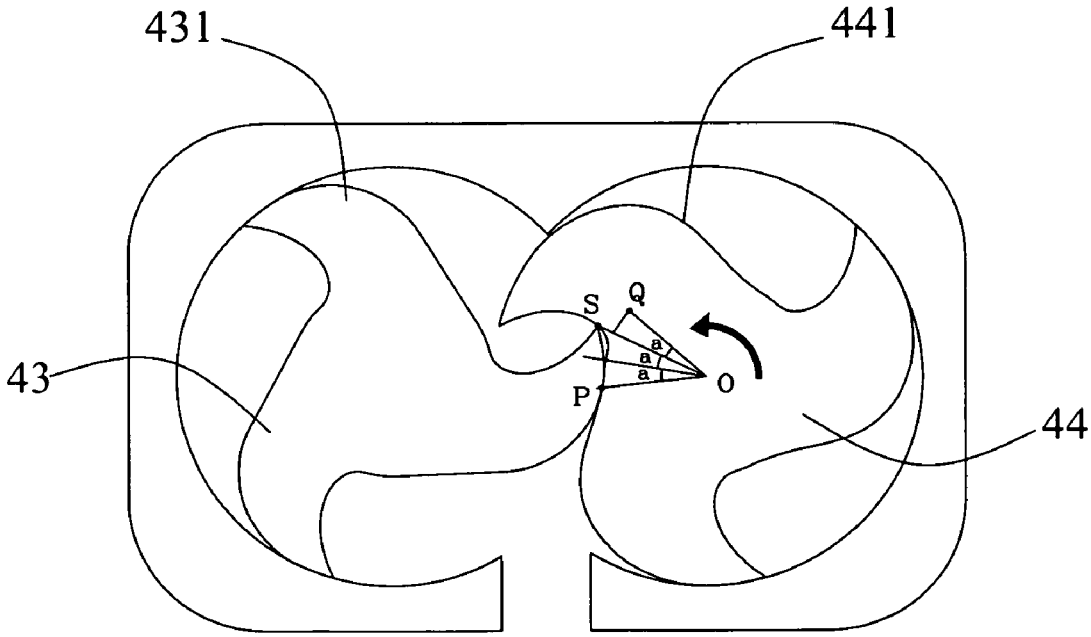
Figure 4C:
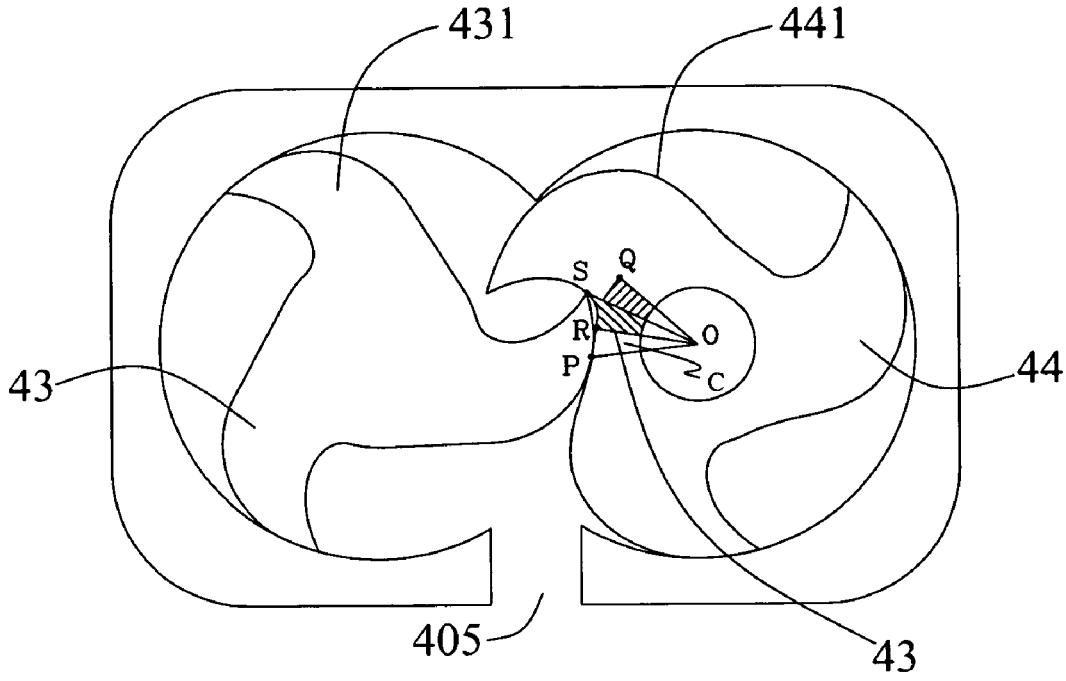

Referring to FIGS. 4A to 4C, a concavity 45 is defined on the lobe 441 of the expansion rotor 44. A profile of the concavity 45 is defined by following steps: when the intermeshing expansion rotors 43, 44 rotate to a combustion area 91, designate a point Q at circumference of the base circle of one of the expansion rotors 44; the point Q is corresponding to the combustion 91 as shown in FIG. 4A, and draw a line QO by connecting the point Q and a center O of the base circle, then rotate the expansion rotor 44 backwards till the recess of the lobe 441 is against a tip of a lobe 431 of an adjoining expansion rotor 43 where a point S is defined as an intersection of the tip and the recess of the lobe 441, and a point P is defined as an intersection of a projecting curve of the lobe 431 of the adjoining expansion rotor 43 and the recess of the lobe 441, and then respectively connect the point S and P to the center O, whereby an angle SOP and angle SOQ are formed and subject to change on rotation of the expansion rotors 43, 44. Referring to FIG. 4C in combination FIG. 4B, take the angle SOP as two times large as the angle SOQ, then make an angle bisector of the angle SOP intersect the profile of the expansion rotor 44 at a point R to form an angle bisector OR, and connect point R and S to form a curve SR; draw an arc about the center O to intersect a line SO and line RO to form an arc C; whereby, the concavity 45 is defined within an area of the curve SR, the arc C, the line SO and line RO.

Figure 4D:
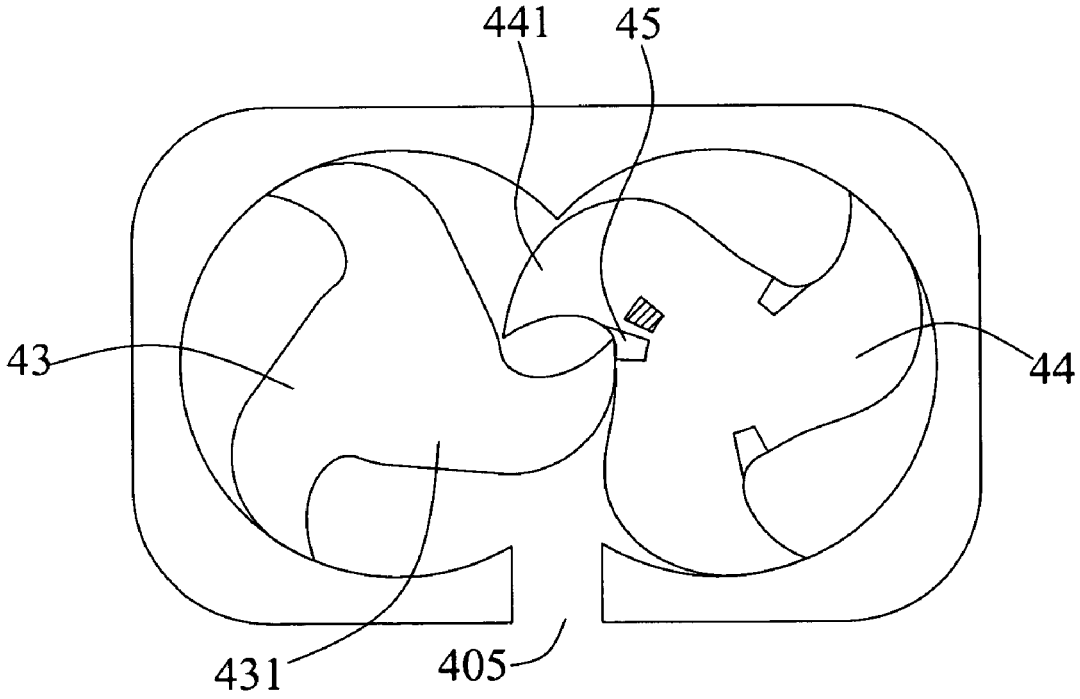
Figure 4E:
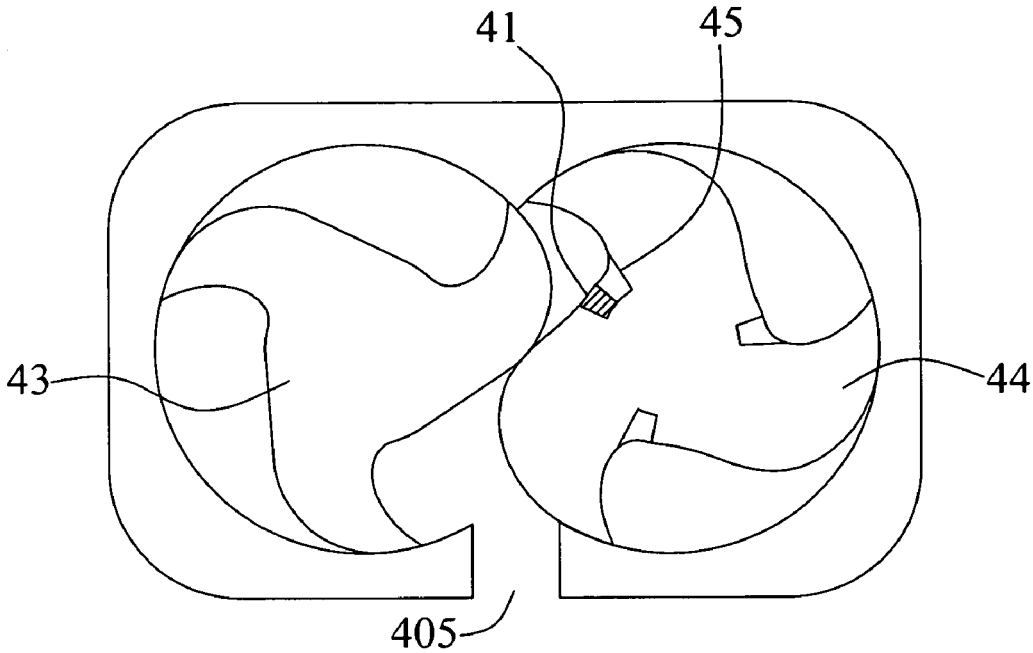
Figure 4F:
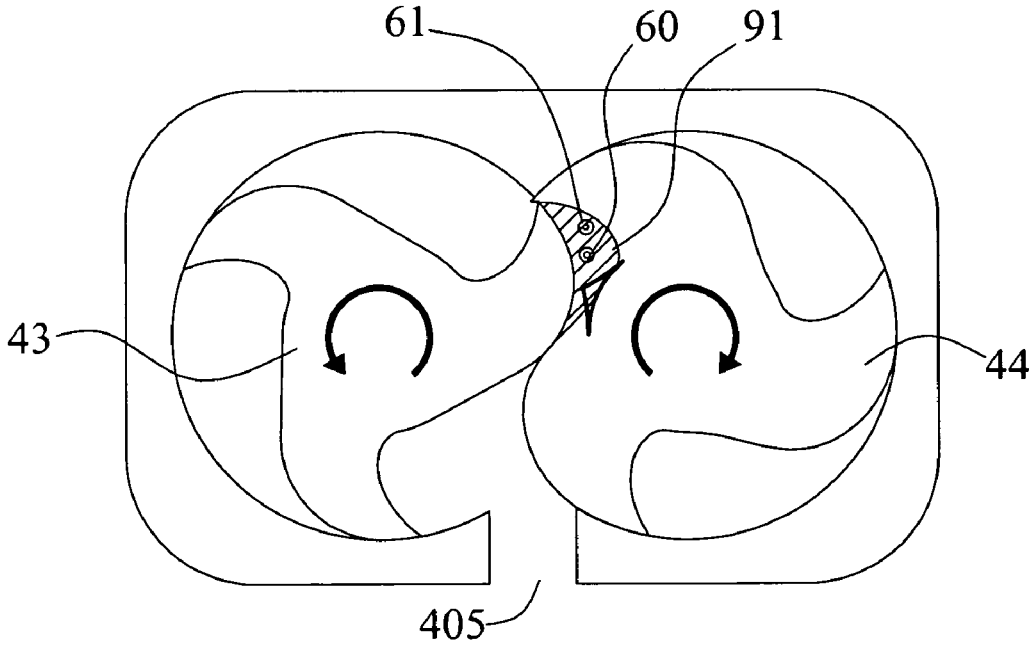

Referring to FIGS. 4A and 4E, the first exhaust slot 41 is defined within an area of the arc C, the line QO and SO, and a segment of the profile of the expansion rotor 44 being taken as the combustion area 91 appears.

Figure 5A:
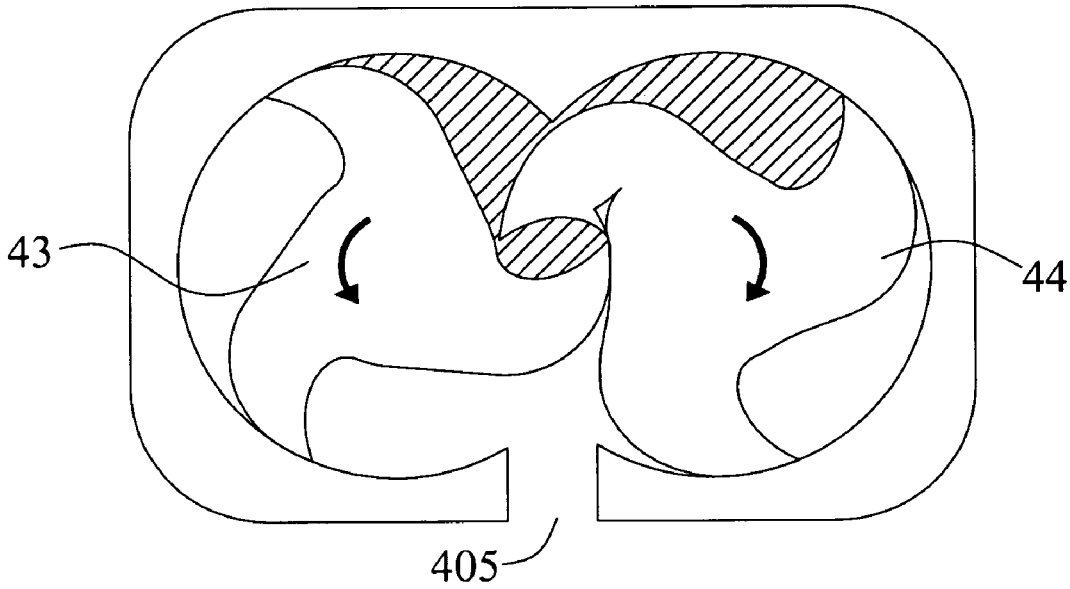
FIGS. 5A to 5C are schematic views showing a process of operation of an expansion assembly of the first embodiment.
Figure 5B:
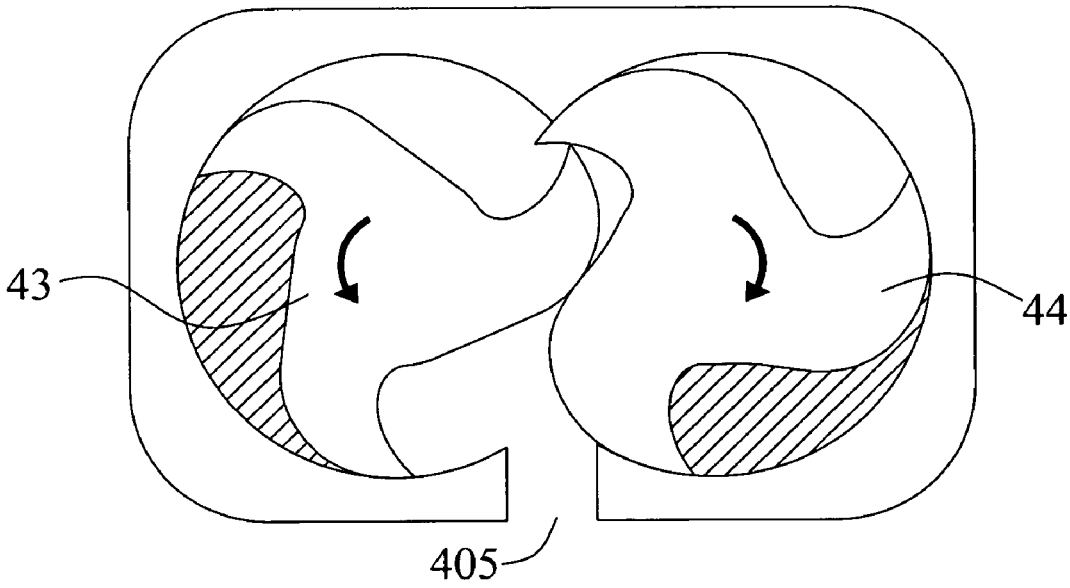
Figure 5C:
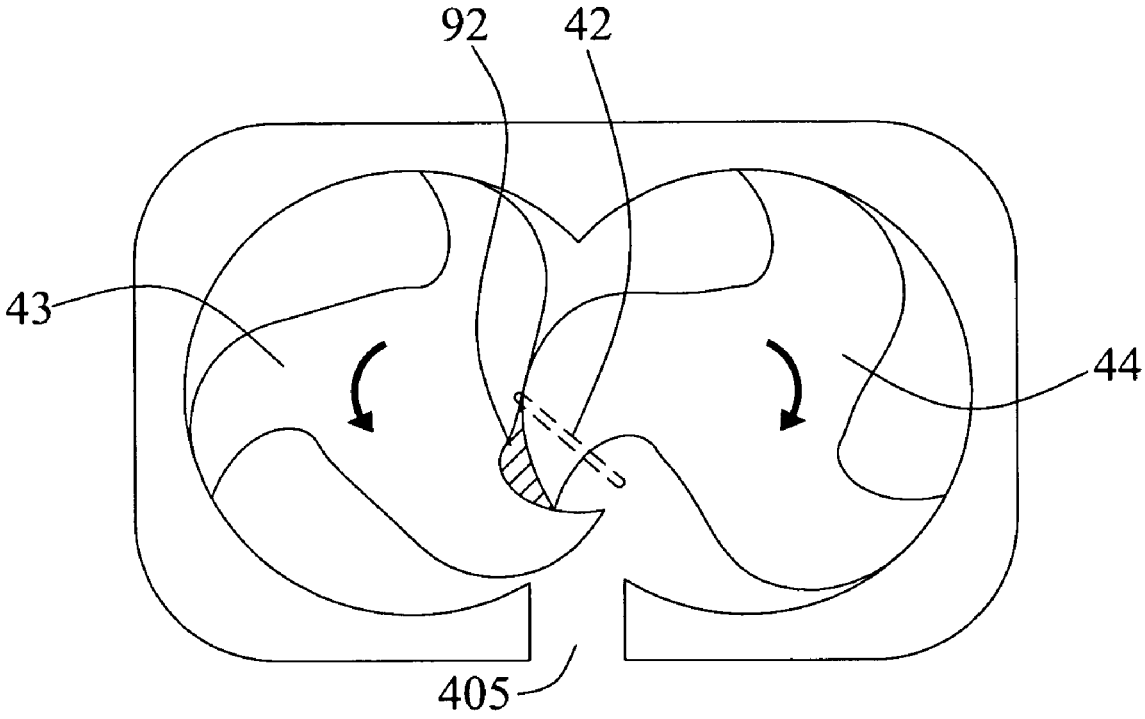

Referring to FIG. 5C, the second exhaust slot 42 is disposed on the sealing second chamber 40 and corresponding to a ultimate seal zone 92 where the compression rotors 43, 44 ultimately intermesh with each other for discharging residual gases.

Figure 3H:
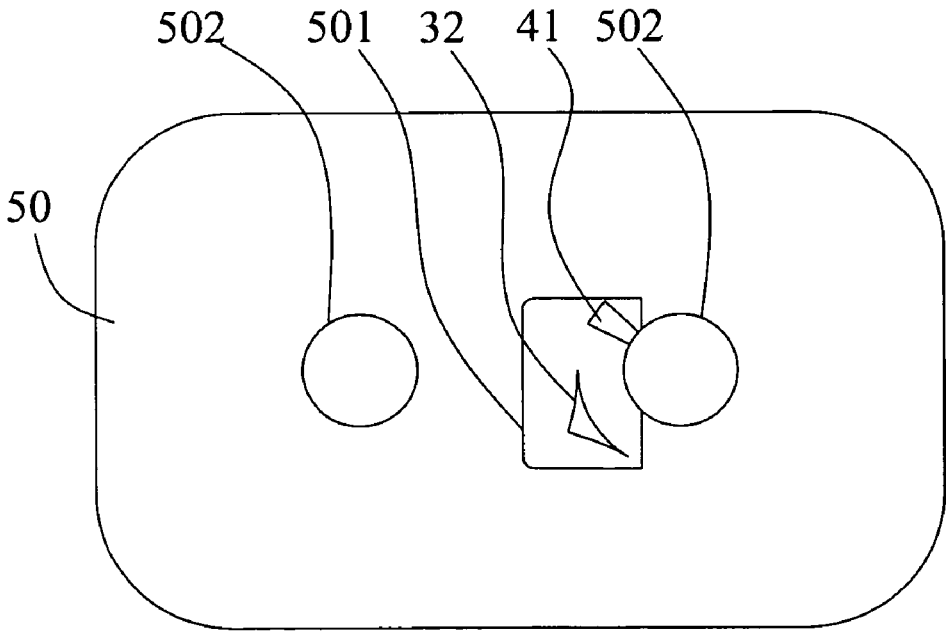

Referring bank to FIG. 1 in combination with FIG. 3H, the buffer assembly 5 is disposed between the compression and expansion rotors 3, 4, and has a base 50, a buffer chamber 501 corresponding to the second intake slot 32 and the first exhaust slot 41, and a plurality of coupling holes 502 being coaxial respectively with the coupling holes 306, 307, 406, 407.

The supply assembly 6 includes a fuel injection means 60 and a spark plug 61 both disposed in the expansion chamber of the initial seal zone where the expansion rotors initially intermesh with each other; accordingly, a gasoline engine is produced.

Referring to FIGS. 3A to 3D, the present invention in operation, negative pressure area is generated in the compression chamber 304 as the compassion rotors 33, 34 begin rotating, and air is sucked in from the intake port 305 (as shown in FIG. 3B). Due to the shape of the compression rotors 33, 34, a seal zone 90 is generated as the compression rotors 33, 34 rotate initially. The seal zone 90 will become vacuum if there is no air filled in. In order to avoid the vacuum situation, air can be admitted from the first intake slot 31 into the seal zone 90 (as shown in FIG. 3A). During the process of rotation of the compression rotors 33, 34, filled air is transported as two parts which will mix together and be compressed in the end of transporting (as shown in FIG. 3C). Meanwhile, air will be discharged through the second intake slot 32 into the buffer chamber 501 (as shown in FIG. 3D). Particularly, opening of the second intake slot 32 is determined by the compression rotor 32, that is, the second intake slot 32 is close because it is covered due to rotation of the compression rotors 33, 34; in turn, the second intake slot is open, and air is admitted into the buffer chamber 501. On the other hand, in order to prevent the second intake slot 32 from being opened too early, which may cause compression ratio of the buffer chamber 501 higher than that of the compressed air, and air returns to the compression chamber 304, a shape and location of the second intake slot 32 are taken into account.

Referring to FIGS. 3E to 3G, the present invention in manufacture, first, rotate the compression rotors 33, 34 to a position where compression ratio of the compressed air and the buffer chamber 501 is the same (as shown in FIG. 3E), then the second intake slot 32 will open as the compression rotors 33, 34 keep rotating, and air will be forced into the buffer chamber 501, therefore, the profile curve 342 of the lobe 341 of the compression rotor 34 indicates an appropriate location to decide opening of the second intake slot 32. Above all, the second intake slot 32 cannot be located at left side of a path of rotation the maximum curve 330, otherwise air will return to the compression chamber 304. Furthermore, the second intake slot 32 cannot be located inside the arc of the base circle 340 of the compression rotors 34 (said arc 340 drawn with a minimum radius of the compression rotor 34) because the second intake slot 32 will always be covered and lose functions thereof. Accordingly, the shape and location of the second intake slot 32 can be defined by the above-described three curves: the arc of the base circle 340 of the compression rotors 34, the profile curve 342 being tangent to the arc 340, and the maximum curve 330 of the compression rotor 33.

Referring to FIG. 3H, the buffer chamber 501 communicates with the second intake slot 32 and the first exhaust slot 41 and can maintain air pressure as a pressure value which is slightly bigger than a pressure value resulted from actual explosion. When the compression rotors 33, 34 keep rotating, the compressed air will be discharged into the buffer chamber 501 to keep a high pressure value. On the other hand, when the first exhaust slot 41 is open, pressure from the buffer chamber 501 will force air flowing rapidly into the expansion chamber 404.

Accordingly, when the air flows into the expansion chamber 404, the fuel supply means injects fuel to mix with the compressed air, meanwhile, the spark plug is ready to be ignited to make explosions. In case the first exhaust slot 41 is not close during the explosions, air will flow back to the buffer chamber 501, and such result is not expected. Referring to FIGS. 4C to 4F, when the expansion rotors 43, 44 rotate as shown in FIG. 4D, the tip of the lobe 431 of the expansion rotor 43 is against the concavity 45; as a result, an opening to the concavity 45 is formed around the tip of the lobe 431. In process of rotation (as shown in FIG. 4B), the tip of the lobe 431 is positioned at the point S, an edge of the concavity 45, and the expansion rotors 43, 44 intersect at point P, whereby, a close area SRP is formed. Keep rotation, the concavity 45 overlaps with the first exhaust slot 41, and the compressed air flows from the buffer chamber 501 into the combustion area 91. Before explosion, the concavity 45 travels across the first exhaust 41 (as shown in FIG. 4E), at the same time, the combustion area 91 is spaced away the buffer chamber 501, and the fuel injection means 60 injects fuel to mix with the compressed air, the spark plug 61 igniting mixed air in the combustion area 91 to cause explosions. By means of vaporization of fuel and vortexes generated from a high-pressure air stream, air and fuel can be mixed completely. The explosions cause combustion gas being expanded and impel rotation of the expansion rotors 43, 44.

Referring to 5A to 5C, after explosions, residual gas is divided into two parts and discharged from the below exhaust port 405 (as shown in FIGS. 5A and 5B). Due to the shape of the expansion rotors 43, 44, the ultimate seal zone 92 is generated at the time ultimate discharge occurs, and wasted gas can be completely discharged from the second exhaust slot 42 (as shown in FIG. 5C)

Figure 6:
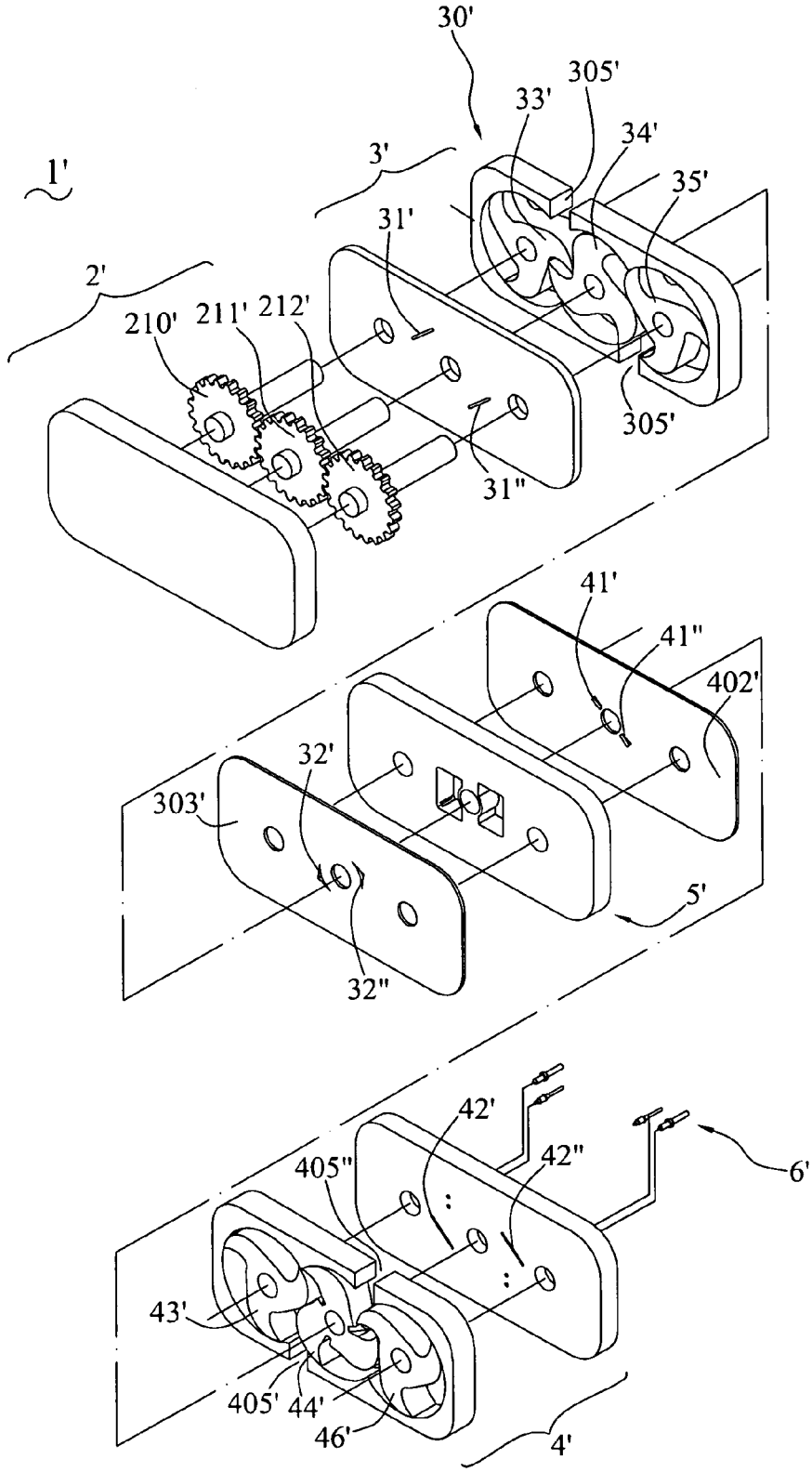
FIG. 6 is a perspective exploded view of the second embodiment of the present invention.
Figure 7A:
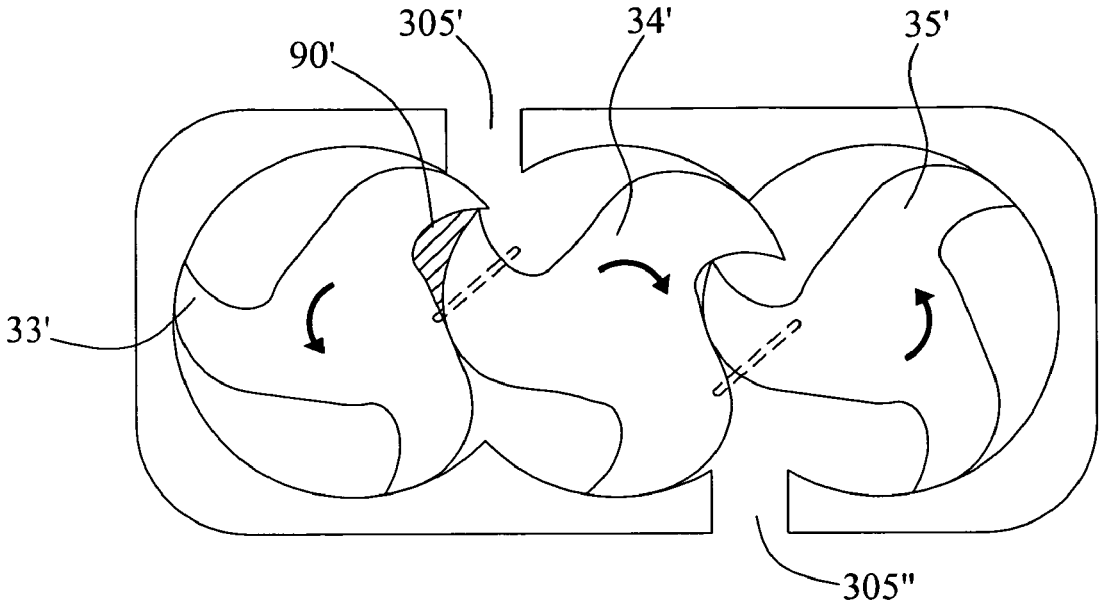
FIGS. 7A to 7D are schematic views showing a process of operation of a compression assembly of the second embodiment.
Figure 7B:
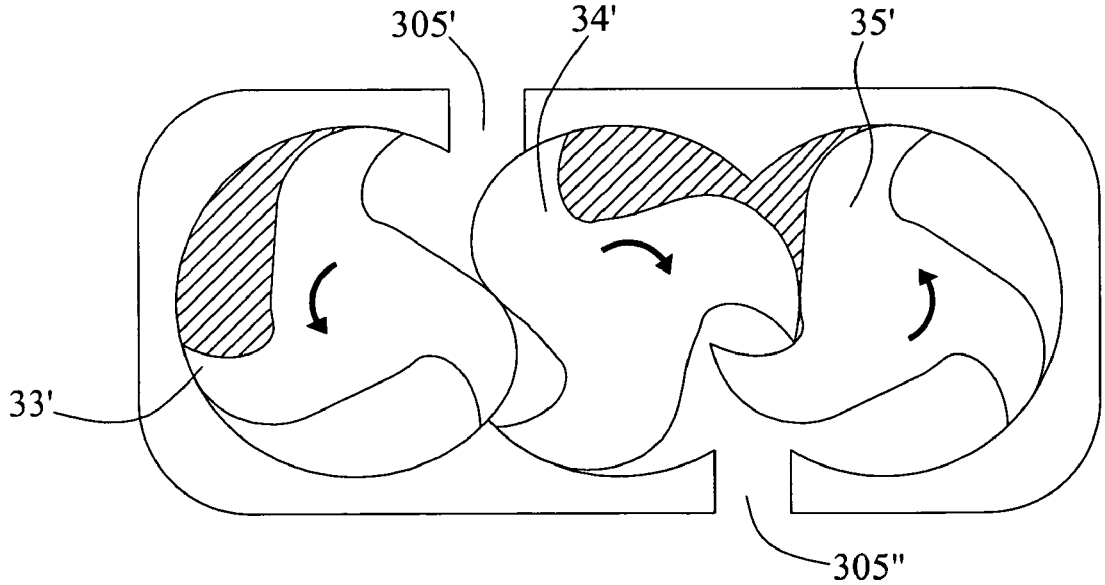
Figure 7C:
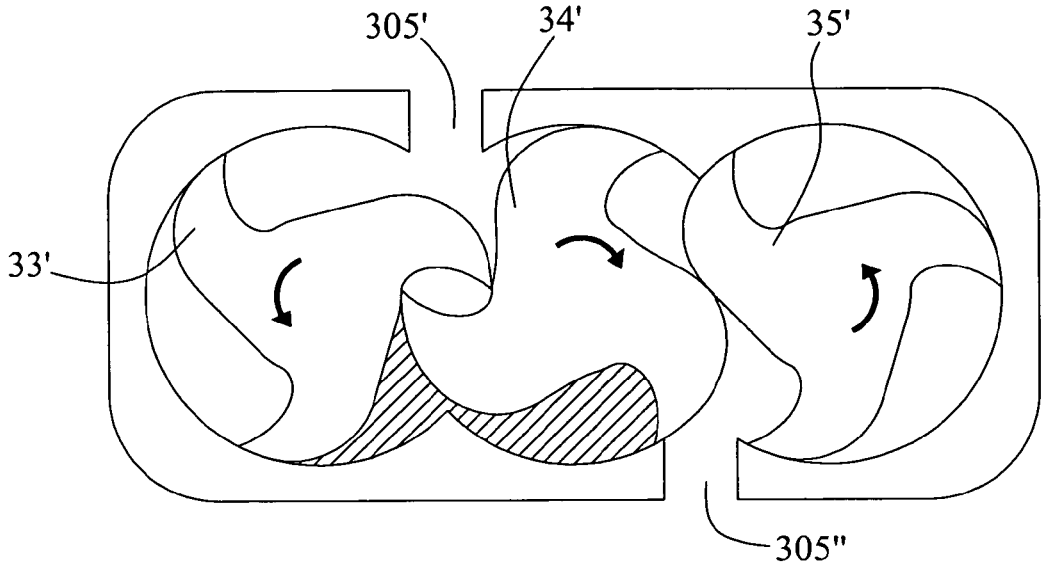
Figure 7D:
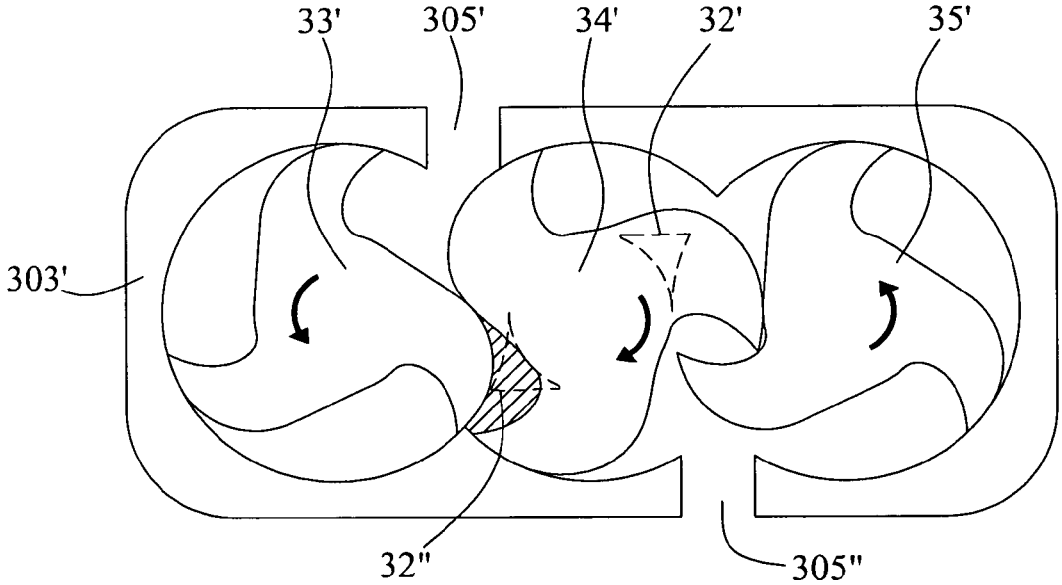

Moreover, number of the intermeshing compression and expansion rotors can be increased to three to enhance power of the engine and to maintain power transmitting in stable; accordingly, number of transmission shaft is also three. FIG. 6 illustrates the second embodiment of the present invention applied to an engine 1' as it is used in the first embodiment. The engine 1' includes the transmission shaft 2', the compression assembly 3', the expansion assembly 4', the buffer assembly 5' and the supply assembly 6'; a marked difference of the first and second embodiments is number of the compression and expansion rotors in the second embodiment is increased, which influences location of the intake port, the first and second intake slot, the exhaust port, the first and second exhaust slot. Referring to FIGS. 7A to 7D, the transmission assembly 2' includes the first, second and third gears 210', 211', 212'. The compression assembly 3' includes the first, second and third compression rotors 33', 34', 35', intermeshing with one another and rotating in a direction of an arrow. The intake port 305' is located above where the compression rotors 33', 34' intermesh with each other. The intake port 305" is located under where the compression rotors 34', 35' intermesh with each other. The first intake slots 31', 31" are respectively disposed on the initial seal zone 90' where the compression rotors 33', 34' and 34', 35' initially intermesh with each other. The second intake slot 32', 32", as shown in FIG. 7D, are disposed on the second casing 303' corresponding to the middle compression rotor 34', wherein the increasing second intake 32" is formed by duplicating and rotating the second intake 32' about the center of the compression rotor 34'. The profile of the second intake slot 32', 32" is generated by the same ways as described before in the first embodiment.

Figure 8A:
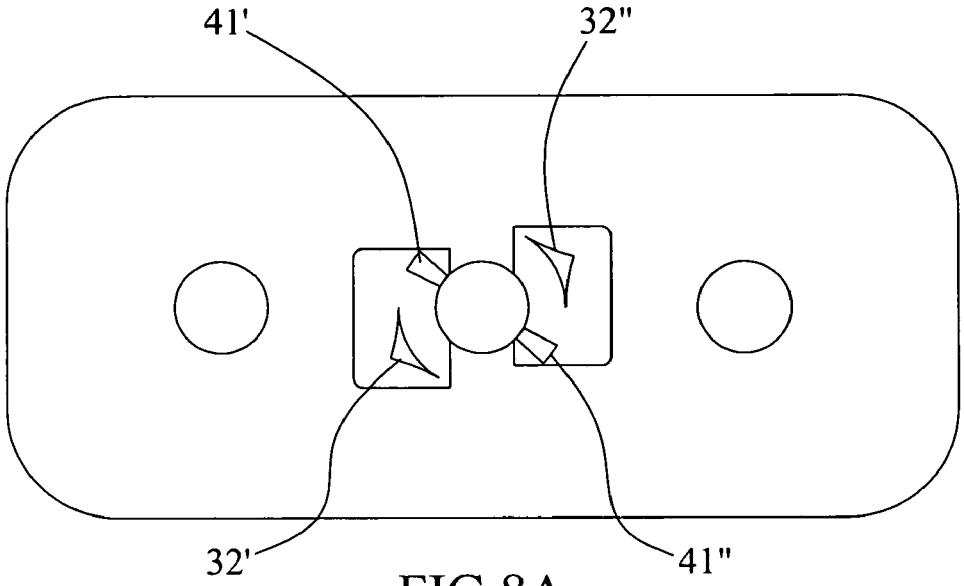
FIGS. 8A to 8C are schematic views showing a process of operation of a buffer assembly of the second embodiment.
Figure 8B:
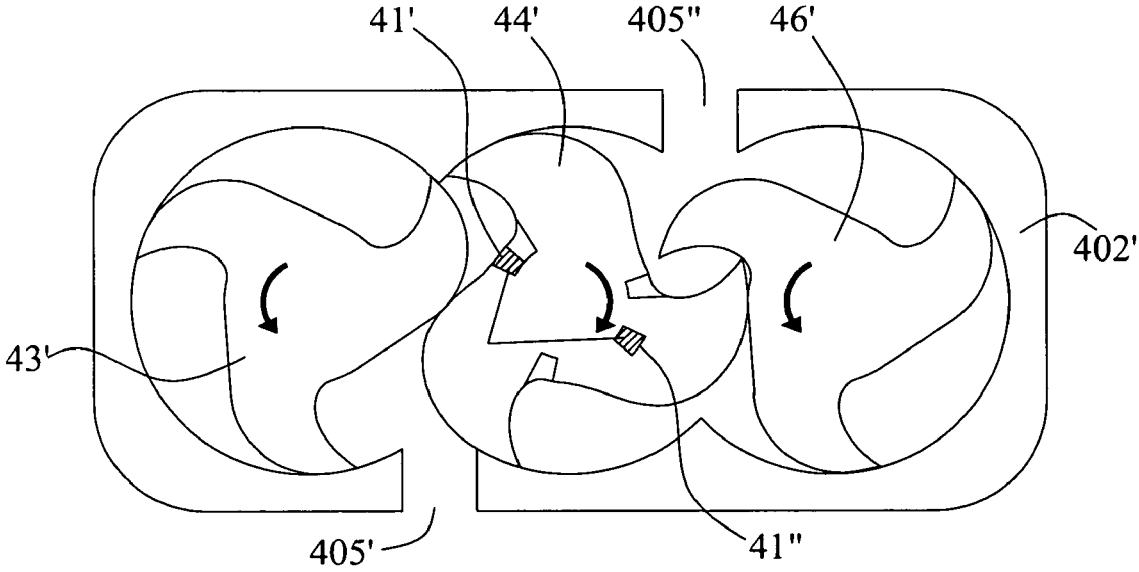
Figure 8C:
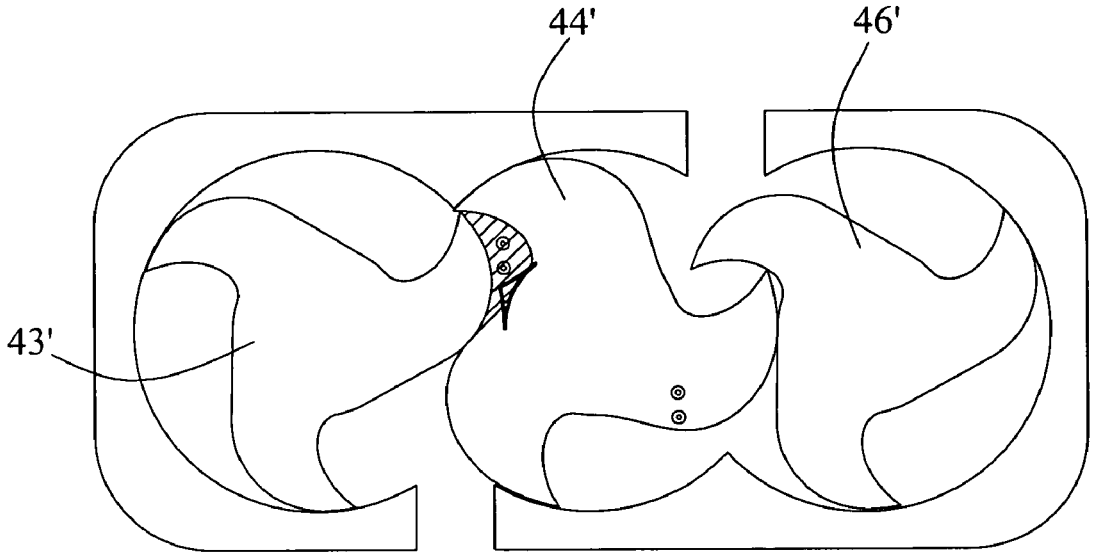
Figure 9A:
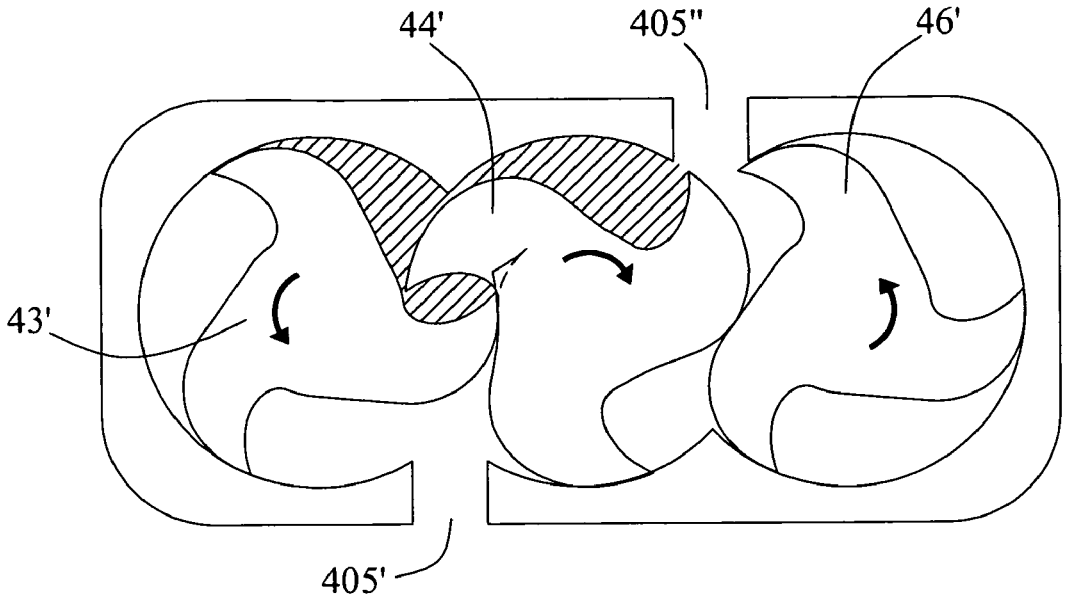
FIGS. 9A to 9C are schematic views showing a process of operation of an expansion assembly of the second embodiment.
Figure 9B:
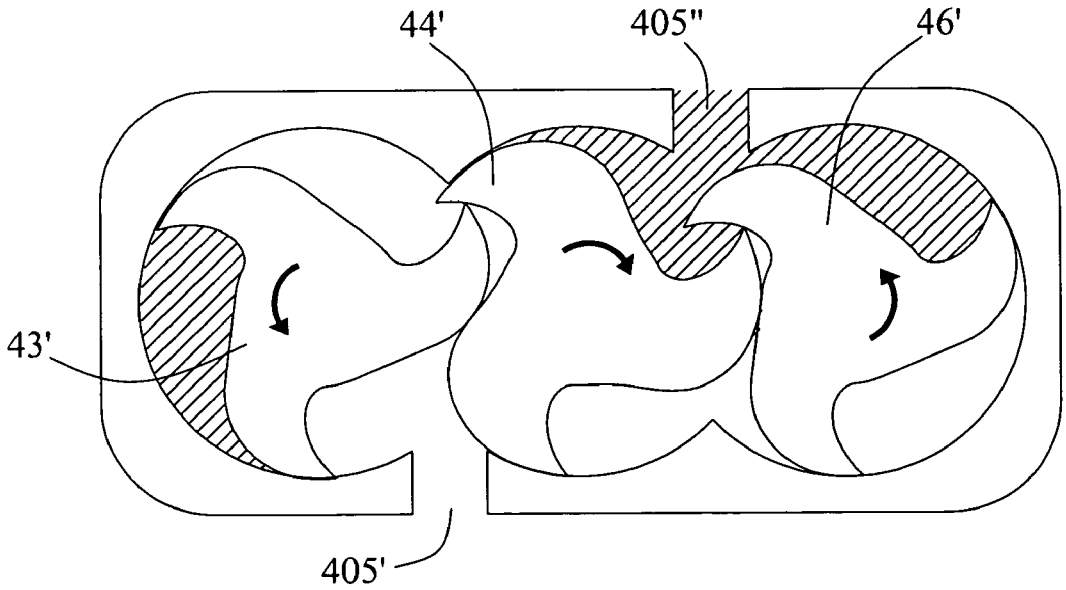
Figure 9C:
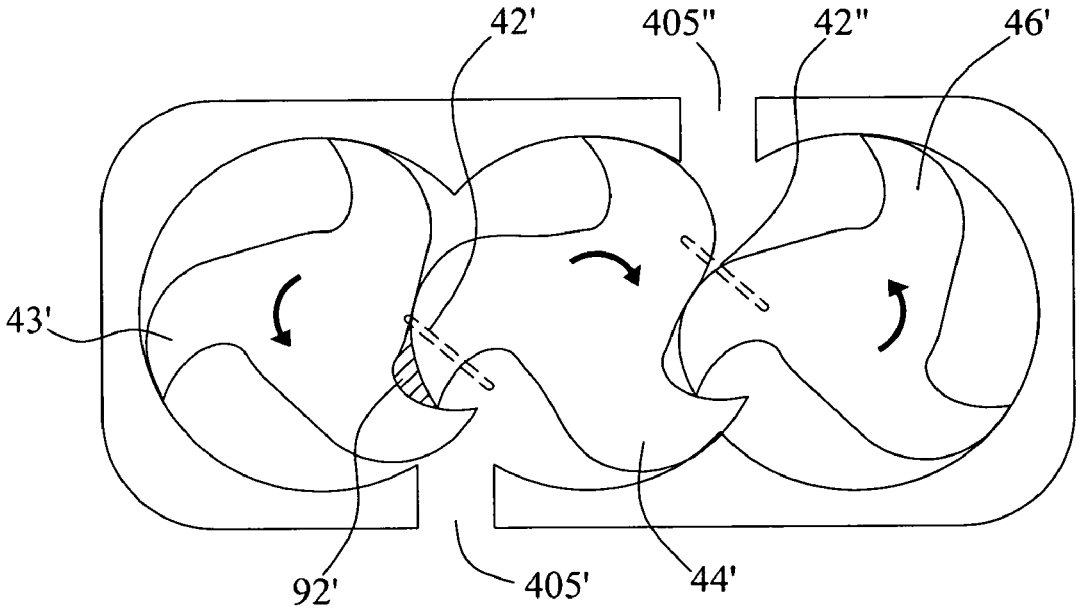

Referring to FIGS. 8A to 8C, the expansion assembly has the expansion rotors 43', 44', 46' intermeshing with one another and rotating in a direction of an arrow as same as the direction of the compression rotors 33', 34', 35'. However, lobes of the expansion rotors 43', 44', 46' disposed in counter direction to lobes of the compression rotors 33', 34', 35'. The exhaust port 405' is located under where the expansion rotors 43', 44' intermesh with each other. The exhaust port 405" is located above where the expansion rotors 44', 46' intermesh with each other. The first exhaust slots 41', 41" are disposed on the third casing 402' corresponding to the expansion rotor 44', wherein the increasing first exhaust slot 41" is formed by duplicating and rotating the first exhaust slot 41'. The profile of the first exhaust slots 41', 41" is generated by the same ways as described before in the first embodiment. The second exhaust slots 42', 42" are respectively disposed on the ultimate seal zone 92' where the expansion rotors 43', 44' and 44', 46' ultimately intermesh with each other.

Figure 10:
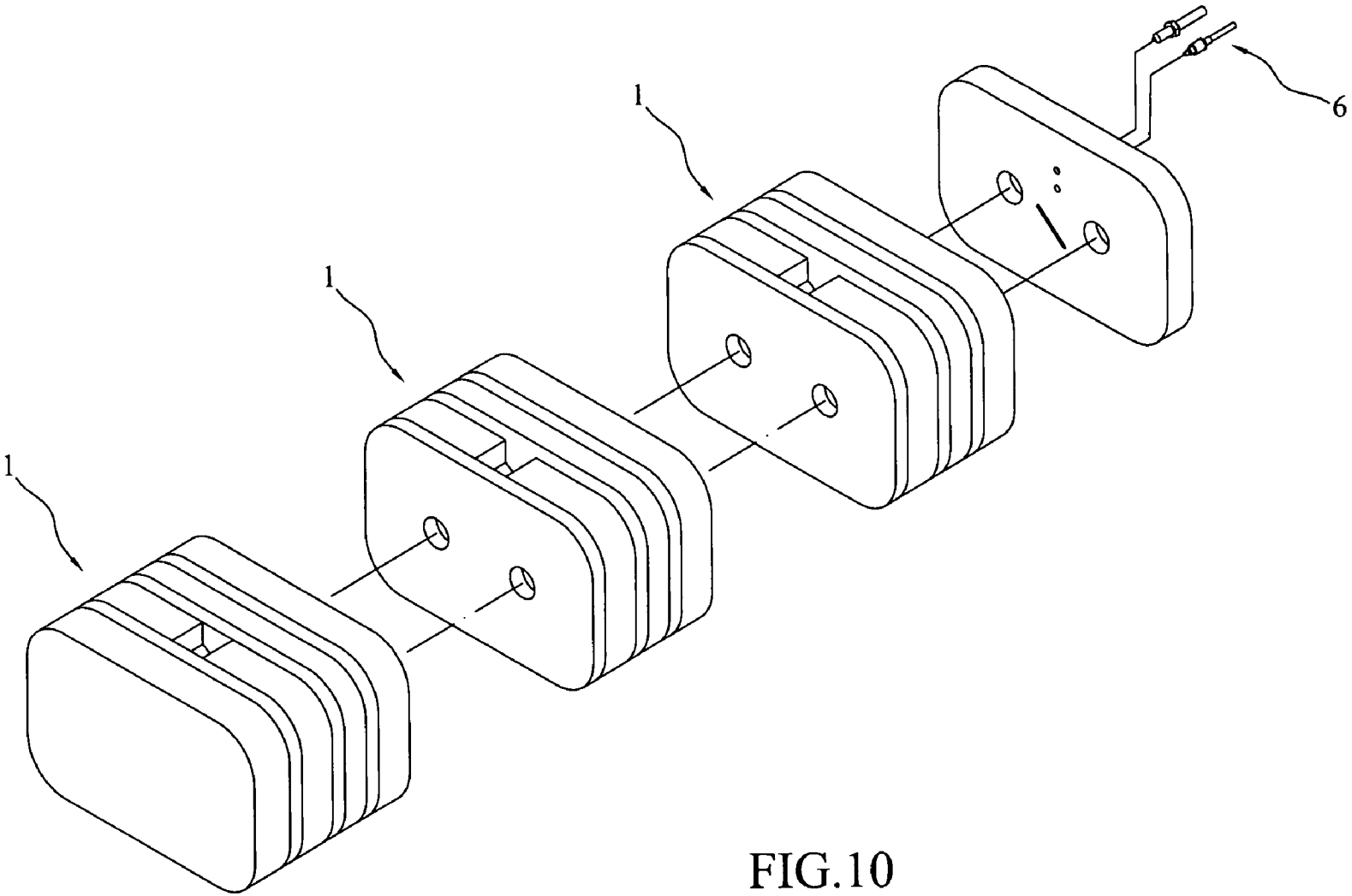
FIG. 10 is a perspective exploded view of the third embodiment of the present invention.

Further referring to FIG. 10, the third embodiment of the present invention includes multiple sets of the rotary positive displacement control system 1 of the first embodiment coupled with one another, each set of the rotary positive displacement control system 1 having the fuel injections assembly 6 to improve power output. On the other hand, the present invention can be varied by adjusting number of the compression and the expansion rotors to be in a ratio of 1:2 and adding one more set of the compression assembly and the buffer assembly to maintain discharge in stable.

Figure 11:
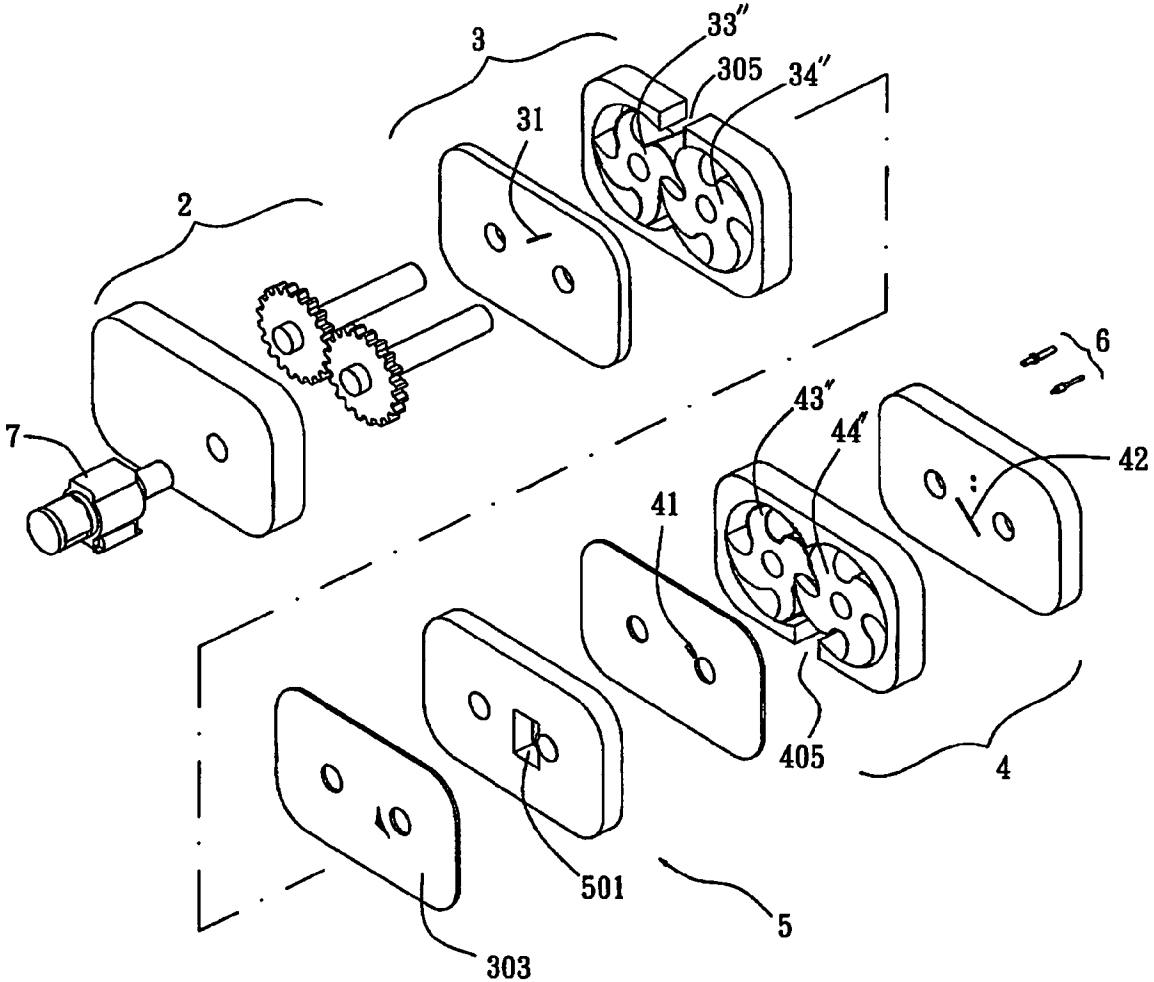
FIG. 11 shows a perspective exploded view and perspective assembled view of the first embodiment of the present invention having 4 lobes.
Figure 12:
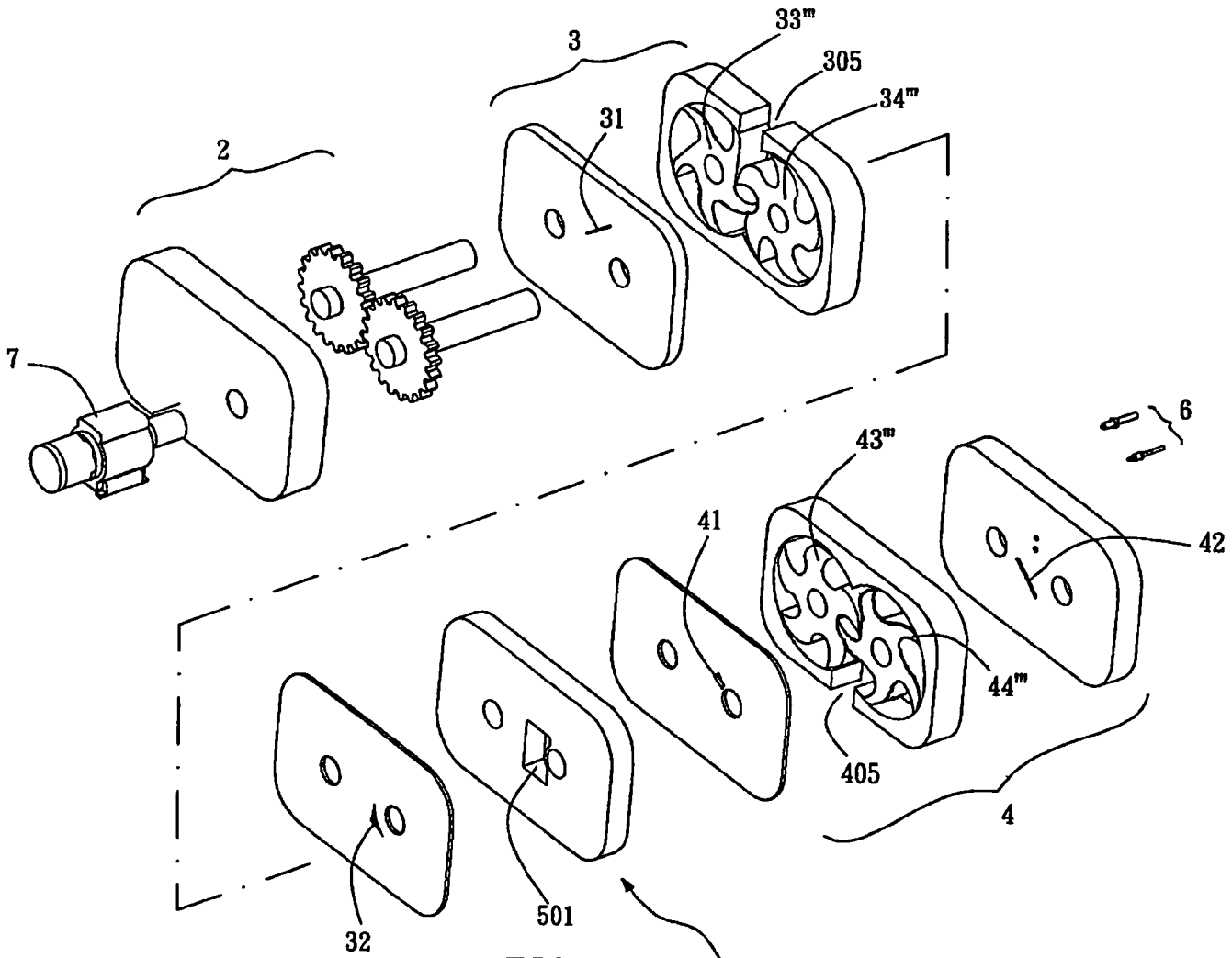
FIG. 12 shows a perspective exploded view and perspective assembled view of the first embodiment of the present invention having 5 lobes.

FIG. 11 illustrates a rotary positive displacement control system and apparatus having 4 lobes 33", 34", 43", 44" with a motor 7. Further, FIG. 12 demonstrates a rotary positive displacement control system and apparatus, having 5 lobes 33''', 34''', 43''', 44''' with a motor 7.

Figure 13:
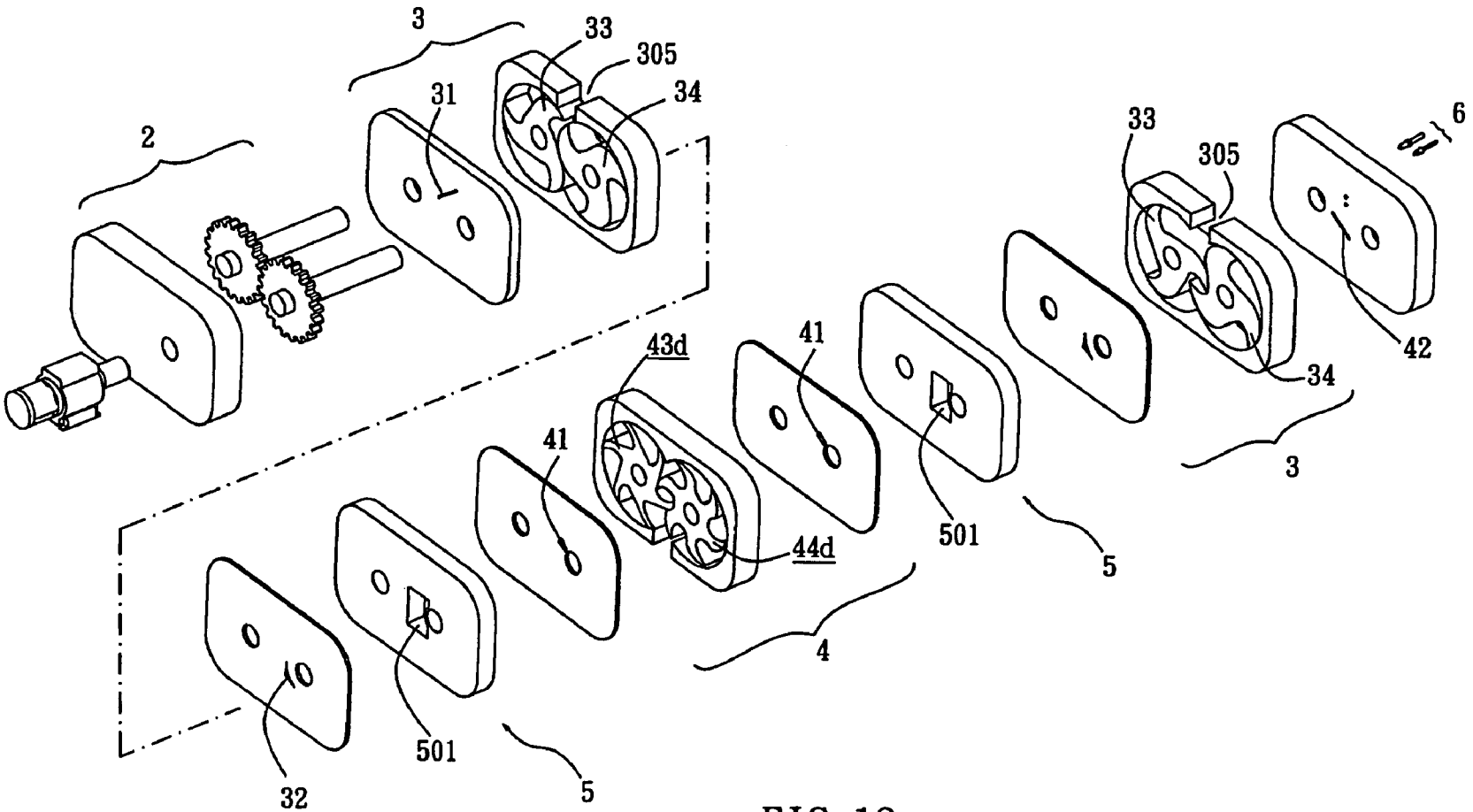
FIG. 13 shows a perspective exploded view and perspective assembled view of the first embodiment of the present invention having 6 lobes.

Moreover, FIG. 13 shows a rotary positive displacement control system and apparatus having 6 lobes 43*d*, 44*d* for the expansion assembly. The compression system 3 has 3 lobes 33, 34 where the number of the lobes of the compression 3 and expansion rotors 4 is at a ratio of 1:2, for which one more set of the compression assembly 3 and the buffer assembly 5 are added for maintaining exhaust.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A rotary positive displacement control system and apparatus, comprising a transmission assembly, a compression assembly, a buffer assembly and an expansion assembly, wherein the transmission assembly includes a axial base, a plurality of transmission members pivotally mounted on the axial base and gearing with each other, and a plurality of transmission shafts for carrying the transmission members;

the compression assembly including a sealing first chamber which defines a compression chamber therein and has an intake port communicating with the compression chamber for taking air in, multiple compression rotors pivotally mounted to the transmission shafts and accommodated in the compression chamber, the compression rotors intermeshing with each other, each of the compression rotor having at least one lobe, and a first intake slot and a second intake slot respectively disposed on opposite sides of the first chamber, wherein the first intake slot is corresponding to an initial seal zone where the compression rotors initially intermesh with each other;

the buffer assembly disposed between the compression assembly and the expansion assembly and having a base and a buffer chamber corresponding to the second intake slot;

the expansion assembly including a sealing second chamber which defines an expansion chamber therein and having an exhaust port communicating with the expansion chamber for discharging air, a first exhaust slot disposed thereon and corresponding to the buffer chamber, multiple expansion rotors pivotally mounted to the transmission shafts and accommodated in the expansion chamber, the expansion rotors intermeshing with each other, each of the expansion rotor having at least one lobe, the compression and expansion rotors are identical in shape and number of the lobes, of which number can be 3, 4 or 5, or number of the lobes of the compression rotor differs from that of the expansion rotor, the lobe disposed in counter direction to the lobe of the compression rotors and having a concavity corresponding to the first exhaust slot, and a second exhaust slot disposed on the sealing second chamber and corresponding to a ultimate seal zone where the compression rotors ultimately intermesh with each other.

2. The rotary positive displacement control system and apparatus as claimed in claim 1, wherein the plurality of transmission members comprise at least a first gear, a second gear, and the transmission shafts for carrying the gears, each gear being engaged with each other.

3. The rotary positive displacement control system and apparatus as claimed in claim 1, wherein a profile of the second intake slot is defined within three curves, comprising: an arc of a base circle of one of the compression rotors (said arc drawn with a minimum radius of the compression rotor), a profile curve of the lobe of the compression rotor being tangent to said arc of the base circle, and a maximum curve of the adjoining compression rotor drawn with a maximum radius thereof and being tangent to said arc of the base circle.

4. The rotary positive displacement control system and apparatus as claimed in claim 1, wherein the sealing first chamber is comprised of a first housing having the compression chamber and the intake port thereon, and a first casing and a second casing sealing the first housing respectively from opposite direction, the first and second casings having coupling holes corresponding to the transmission shafts.

5. The rotary positive displacement control system and apparatus as claimed in claim 1, wherein number of the lobes of the compression and expansion rotors is at a ratio of 1:2, for which one more set of the compression assembly and the buffer assembly are added for maintaining exhaust.

6. The rotary positive displacement control system and apparatus as claimed in claim 1, wherein the sealing second chamber is comprised of a second housing having the expansion chamber and the exhaust port thereon, and a third casing and a fourth casing sealing the second housing respectively from opposite direction, the third and fourth casings having coupling holes corresponding to the transmission shafts.

7. The rotary positive displacement control system and apparatus as claimed in claim 1, wherein the expansion rotor has a concavity corresponding to the first exhaust slot.

8. The rotary positive displacement control system and apparatus as claimed in claim 6, wherein the concavity of the lobe of the expansion rotor is defined by following steps:

as the intermeshing expansion rotors rotate up to a combustion area, designate a point Q at circumference of the base circle of one of the expansion rotors, the point Q corresponding to the combustion area, and draw a line QO by connecting the point Q and a center O of the base circle; then rotate the expansion rotor backwards till a recess of the lobe is against a tip of a lobe of an adjoining expansion rotor where a point S is defined as an intersection of the tip and the recess of the lobe, and a point P is defined as an intersection of a projecting curve of the lobe of the adjoining expansion rotor and the recess of the lobe, and then respectively connect the point S and P to the center O, whereby an angle SOP and angle SOQ are formed and subject to change on rotation of the compassion rotors make the angle SOP to be two times the angle SOQ, then make an angle bisector of the angle SOP intersect the profile of the expansion rotor at a point R to form an angle bisector OR; connect point R and S to form a curve SR; draw an arc about the center O to intersect a line SO and line RO to form an arc C; whereby, the concavity is defined within an area of the curve SR, the arc C, the line SO and line RO.

9. The rotary positive displacement control system and apparatus as claimed in claim 7, wherein a profile of the first exhaust slot is defined within an area of the arc C, the line QO and SO, and a segment of the profile of the expansion rotor being taken as the combustion area appears.

10. The rotary positive displacement control system and apparatus as claimed in claim 1, a profile of the second intake slot is defined within three curves, comprising: an arc of a base circle of one of the compression rotors (said arc drawn with a minimum radius of the compression rotor), a profile curve of the lobe of the compression rotor being tangent to said arc of the base circle, and a maximum curve of the adjoining compression rotor drawn with a maximum radius thereof and being tangent to said arc of the base circle, wherein an additional second intake slot is added as number of the compression rotor is more than two.

11. The rotary positive displacement control system and apparatus as claimed in claim 1, further duplicating the second exhaust slot by rotating about the center O as number of the compression rotor is more than two.

12. The rotary positive displacement control system and apparatus as claimed in claim 1, further comprising a supplying assembly including a fuel injection means and a spark plug both disposed in the expansion chamber of the initial seal zone where the expansion rotors initially intermesh with each other.

13. The rotary positive displacement control system and apparatus as claimed in claim 1, further comprising a fuel injection means disposed in the expansion chamber corresponding to the initial seal zone where the expansion rotors initially intermesh with each other.

14. The rotary positive displacement control system and apparatus as claimed in claim 1, further comprising a power transmitting assembly including at least a motor mounted to the transmission assembly.

15. The supercharge control system and apparatus, comprising multiple sets of rotary positive displacement control system being coaxially coupled to one another through a transmission assembly, each rotary positive displacement system comprising at least a compression assembly, a buffer assembly and an expansion assembly, wherein the compression assembly includes a sealing first chamber which defines a the compression chamber thereon and has an intake port communicating with the compression chamber for taking air in, multiple compression rotors pivotally mounted to the transmission shafts and accommodated in the compression chamber, the compression rotors intermeshing with each other, each compression rotor having at least one lobe, and a first intake slot and a second intake slot respectively disposed on opposite sides of the first chamber;

the buffer assembly disposed between the compression assembly and the expansion assembly and having a base and a buffer chamber corresponding to the second intake slot;

the expansion assembly including a sealing second chamber defining an expansion chamber thereon and having an exhaust port communicating with the expansion chamber for discharging air, a first exhaust slot disposed thereon and corresponding to the buffer chamber, multiple expansion rotors pivotally mounted to the transmission shafts and accommodated in the expansion chamber, the expansion rotors intermeshing with each other, each expansion rotor having at least one lobe, the lobe disposed in counter direction to the lobe of the compression rotors, and a second exhaust slot disposed on the sealing second chamber and corresponding to a ultimate seal zone where the compression rotors ultimately intermesh with each other.

16. The rotary positive displacement control system and apparatus as claimed in claim 15 wherein the transmission assembly comprises a first gear, a second gear gearing with each other, and the transmission shafts for carrying the gears.

17. The rotary positive displacement control system and apparatus as claimed in claim 15, wherein the first intake slot is corresponding to an initial seal zone where the compression rotors initially intermesh with each other.

18. The rotary positive displacement control system and apparatus as claimed in claim 15, wherein a profile of the second intake slot is defined within three curves, comprising: an arc of a base circle of one of the compression rotors (said arc drawn with a minimum radius of the compression rotor), a profile curve of the lobe of the compression rotor being tangent to said arc of the base circle, and a maximum curve of the adjoining compression rotor drawn with a maximum radius thereof and being tangent to said arc of the base circle.

19. The rotary positive displacement control system and apparatus as claimed in claim 15, wherein the compression and expansion rotors are identical in shape and number of the lobes, of which number can be 3, 4 or 5, or number of the lobes of the compression rotor differs from that of the expansion rotor.

20. The rotary positive displacement control system and apparatus as claimed in claim 15, wherein number of the lobes of the compression and expansion rotors is at a ratio of 1:2, for which one more set of the compression assembly and buffer assembly are added for maintaining exhaust.

21. The rotary positive displacement control system and apparatus as claimed in claim 15, wherein the expansion rotor has a concavity corresponding to the first exhaust slot.

22. The rotary positive displacement control system and apparatus as claimed in claim 15, wherein the concavity of the lobe of the expansion rotor is defined by following steps:

as the intermeshing expansion rotors rotate up to a combustion area, designate a point Q at circumference of the base circle of one of the expansion rotors, the point Q corresponding to the combustion area, and draw a line QO by connecting the point Q and a center O of the base circle; then rotate the expansion rotor backwards till a recess of the lobe is against a tip of a lobe of an adjoining expansion rotor where a point S is defined as an intersection of the tip and the recess of the lobe, and a point P is defined as an intersection of a projecting curve of the lobe of the adjoining expansion rotor and the recess of the lobe, and then respectively connect the point S and P to the center O, whereby an angle SOP and angle SOQ are formed and subject to change on rotation of the compassion rotors make the angle SOP to be two times the angle SOQ, then make an angle bisector of the angle SOP intersect the profile of the expansion rotor at a point R to form an angle bisector OR; connect point R and S to form a curve SR; draw an arc about the center O to intersect a line SO and line RO to form an arc C; whereby, the concavity is defined within an area of the curve SR, the arc C, the line SO and line RO.

23. The rotary positive displacement control system and apparatus as claimed in claim 22, wherein a profile of the first exhaust slot is defined within an area of the arc C, the line QO and SO, and a segment of the profile of the expansion rotor being taken as the combustion area appears.

24. The rotary positive displacement control system and apparatus as claimed in claim 15, each rotary positive displacement control system further comprising a fuel injection means and a spark plug both disposed in the expansion chamber corresponding to an initial seal zone where the expansion rotors initially intermesh with each other.

25. The rotary positive displacement control system and apparatus as claimed in claim 15, each rotary positive displacement control system further comprising a fuel injection means disposed in the expansion chamber corresponding to the initial seal zone where the expansion rotors initially intermesh with each other.

* * * * *